US012593914B2

(12) United States Patent
Nilsson et al.

(10) Patent No.: US 12,593,914 B2
(45) Date of Patent: Apr. 7, 2026

(54) STORAGE COMPONENTS FOR A CONFIGURABLE STORAGE SYSTEM

(71) Applicants: Elfa International AB, Vastervik (SE); The Container Store, Inc., Coppell, TX (US)

(72) Inventors: Peter Nilsson, Vastervik (SE); Lars Ryden, Vastervik (SE); Rolf Henriksson, Ankarsrum (SE)

( * ) Notice: Subject to any disclaimer, the term of this patent is extended or adjusted under 35 U.S.C. 154(b) by 0 days.

(21) Appl. No.: 17/276,109

(22) PCT Filed: Oct. 31, 2018

(86) PCT No.: PCT/US2018/058598

§ 371 (c)(1),
(2) Date: Mar. 12, 2021

(87) PCT Pub. No.: WO2020/055438

PCT Pub. Date: Mar. 19, 2020

(65) Prior Publication Data

US 2022/0047071 A1 Feb. 17, 2022

(30) Foreign Application Priority Data

Sep. 12, 2018 (WO) ..... PCT/US2018/050781

(51) Int. Cl.
*A47B 47/02* (2006.01)
*A47B 57/34* (2006.01)
(Continued)

(52) U.S. Cl.
CPC ..... *A47B 47/022* (2013.01); *A47B 57/34* (2013.01); *A47B 57/42* (2013.01); *A47B 96/061* (2013.01);
(Continued)

(58) Field of Classification Search
CPC ..... A47B 47/022; A47B 57/34; A47B 57/42; A47B 96/061; A47B 96/1408; A47B 2220/003; A47F 5/0838; A47F 5/103
(Continued)

(56) References Cited

U.S. PATENT DOCUMENTS 2,562,290 A 7/1951 Dickerson
2,644,591 A 7/1953 Mcmahan
(Continued)

FOREIGN PATENT DOCUMENTS

CA 2737714 A1 10/2012
CN 2648906 Y 10/2004
(Continued)

OTHER PUBLICATIONS

International Search Report issued in corresponding Application No. PCT/US2018/050781, mailed Feb. 14, 2019.
(Continued)

*Primary Examiner* — Daniel J Troy
*Assistant Examiner* — Timothy M Ayres
(74) *Attorney, Agent, or Firm* — Marc A. Hubbard; Hubbard Law, PLLC

(57) ABSTRACT

A storage system in which storage components are connected in a cantilevered fashion to vertical standard uses thin cantilevered brackets support storage components. Despite the tendency of such brackets to swing when attached to the vertical standard, the cantilevered brackets are constructed and support the storage components in a sturdy and aesthetically pleasing manner. A thin cantilevered bracket made from a single, flat piece of metal oriented vertically and projecting from a connection interface includes a ledge extending from its side surface below a top edge of the bracket to support one end of a shelf or other planar member forming a storage component. A thin cantilevered bracket
(Continued)

with an offset projection that attaches to an inside surface of a side panel of an enclosure that allows the side panel to align with the bracket connection interface.

29 Claims, 20 Drawing Sheets

(51) Int. Cl.

| | |
|---|---|
| ***A47B 57/42*** | (2006.01) |
| ***A47B 96/06*** | (2006.01) |
| ***A47B 96/14*** | (2006.01) |
| ***A47F 5/08*** | (2006.01) |
| ***A47F 5/10*** | (2006.01) |

(52) U.S. Cl.
CPC ..... *A47B 96/1408* (2013.01); *A47F 5/0838* (2013.01); *A47F 5/103* (2013.01); *A47B 2220/0036* (2013.01)

(58) Field of Classification Search
USPC ..... 108/108, 109
See application file for complete search history.

(56) References Cited

U.S. PATENT DOCUMENTS 2,661,993 A 12/1953 Little
2,919,033 A * 12/1959 Lundqvist ..... A47B 57/42 248/250
2,921,693 A 1/1960 Mclean
3,278,248 A 10/1966 Tibor
3,325,129 A 6/1967 Tinfow et al.
3,331,514 A * 7/1967 Bruynzeel ..... A47B 57/34 312/351
3,563,182 A * 2/1971 MacFarlane ..... A47B 61/003 108/138
3,592,493 A 7/1971 Goose
3,601,347 A 8/1971 Attwood et al.
3,645,486 A 2/1972 Ferdinand et al.
3,647,080 A 3/1972 Denny
3,765,344 A 10/1973 Ferdinand et al.
3,771,466 A 11/1973 Ferdinand et al.
3,828,937 A 8/1974 Nash
3,848,844 A 11/1974 Barrett
3,865,336 A * 2/1975 Robertson ..... A47B 61/00 108/29
3,993,002 A 11/1976 Stroh
4,069,638 A 1/1978 Hasselqvist et al.
4,285,484 A * 8/1981 Follows ..... A47B 61/00 108/29
4,312,086 A * 1/1982 Bianco ..... A47B 83/00 5/2.1
4,411,400 A 10/1983 Everett
4,711,420 A 12/1987 Cowler et al.
4,735,470 A 4/1988 Falk
4,816,205 A 3/1989 Gallix
4,938,442 A 7/1990 Mastrodicasa
4,944,566 A 7/1990 Carper
5,004,198 A 4/1991 Jager
5,004,201 A 4/1991 Bessinger
5,007,608 A 4/1991 Carroll, Jr.
5,014,902 A 5/1991 Heimendinger
5,074,009 A 12/1991 Simonton et al.
5,110,080 A 5/1992 Rieman
5,348,385 A 9/1994 Berg
5,377,851 A 1/1995 Asano et al.
5,472,103 A 12/1995 Merl
5,509,541 A 4/1996 Merl
5,531,416 A * 7/1996 Remmers ..... A47G 25/0692 248/222.51
5,551,772 A 9/1996 Keffer
5,720,230 A * 2/1998 Mansfield ..... A47F 5/0043 211/DIG. 1
6,185,887 B1 2/2001 Strassle
6,195,953 B1 3/2001 Gitter et al.
6,428,128 B1 8/2002 Henriott et al.
6,497,185 B1 * 12/2002 Barrett ..... A47B 96/025 108/143
6,592,194 B2 7/2003 Lininger et al.
D479,932 S 9/2003 Clucas
6,688,568 B1 2/2004 Moufflet
D529,254 S 9/2006 Huguet
7,401,705 B2 7/2008 Craft
D577,936 S 10/2008 Held
D674,626 S 1/2013 Gasser
D680,361 S 4/2013 Zobel et al.
D684,402 S 6/2013 Gasser
D684,403 S 6/2013 Gasser
D684,566 S 6/2013 Sexton
D722,831 S 2/2015 Tuang et al.
D732,864 S 6/2015 Clouse et al.
D733,431 S 7/2015 Kokenge
9,130,326 B2 9/2015 Meis
9,131,771 B2 9/2015 Lindblom
D748,916 S 2/2016 Nilsson
D761,236 S 7/2016 Wengreen
9,398,819 B2 7/2016 Tsai
D766,634 S 9/2016 Nilsson et al.
9,476,441 B2 10/2016 Strassle et al.
D770,206 S 11/2016 Nilsson et al.
D773,216 S 12/2016 Nilsson
D775,467 S 1/2017 Nilsson
D784,745 S 4/2017 Nilsson et al.
D785,605 S 5/2017 Hochman et al.
D789,718 S 6/2017 Gokhale et al.
9,743,762 B1 * 8/2017 Beuses ..... A47B 61/003
D800,185 S 10/2017 Onrat
D801,094 S 10/2017 Verna
D807,641 S 1/2018 Nilsson
D808,269 S 1/2018 Colombo
D808,697 S 1/2018 Heckler
9,869,115 B2 1/2018 Nilsson
9,879,460 B2 1/2018 Nilsson
D809,672 S 2/2018 Brennan et al.
D819,732 S 6/2018 Nilsson
D821,749 S 7/2018 Nilsson
D823,622 S 7/2018 Nilsson
10,012,255 B2 7/2018 Knutson et al.
10,016,057 B1 7/2018 Arnautovic et al.
10,028,582 B2 7/2018 Nilsson
10,051,958 B2 8/2018 Andersson
10,104,959 B2 10/2018 Nilsson
10,287,057 B2 5/2019 Nilsson
10,906,706 B2 2/2021 Nilsson
D973,476 S 12/2022 Ryden
D984,257 S 4/2023 Nilsson
2002/0043914 A1 4/2002 Munday et al.
2005/0056604 A1 3/2005 Chen
2005/0109720 A1 5/2005 Marchetta
2005/0109901 A1 5/2005 Stitchick
2005/0150436 A1 7/2005 Marchetta
2005/0160691 A1 7/2005 Kim
2005/0247651 A1 11/2005 Craft
2007/0221597 A1 9/2007 Chen
2008/0142669 A1 6/2008 Zlotocha
2008/0173778 A1 7/2008 Mertens
2009/0139943 A1 6/2009 Fernandez
2009/0152217 A1 6/2009 Gmerek
2010/0001159 A1 1/2010 Kao
2011/0025180 A1 2/2011 Ilich
2014/0138332 A1 5/2014 Loree et al.
2015/0076983 A1 3/2015 Lindblom
2015/0296982 A1 10/2015 Chen et al.
2016/0227944 A1 8/2016 Gonzalez et al.
2016/0316939 A1 11/2016 Kraiss
2017/0112282 A1 4/2017 Will
2018/0132610 A1 5/2018 Lu et al.
2018/0135796 A1 5/2018 Lu
2018/0231176 A1 8/2018 Sabounjian
2019/0110593 A1 4/2019 Nilsson et al.
2019/0387902 A1 12/2019 Peck et al.
2020/0154887 A1 5/2020 Nilsson

(56) References Cited

U.S. PATENT DOCUMENTS

| | | | | |
|---|---|---|---|---|
| 2020/0187675 | A1 | 6/2020 | Obitts | |
| 2020/0196757 | A1 | 6/2020 | Nilsson | |
| 2020/0288866 | A1* | 9/2020 | Richard | A47B 96/06 |
| 2020/0317403 | A1 | 10/2020 | Nilsson | |
| 2021/0274933 | A1 | 9/2021 | Nilsson | |
| 2021/0394954 | A1 | 12/2021 | Nilsson | |
| 2022/0338627 | A1 | 10/2022 | Ringenhag | |
| 2023/0023464 | A1 | 1/2023 | Nilsson | |
| 2023/0026525 | A1 | 1/2023 | Nilsson | |
| 2023/0192355 | A1 | 6/2023 | Nilsson | |

FOREIGN PATENT DOCUMENTS

| | | | |
|---|---|---|---|
| CN | 101384146 | A | 3/2009 |
| CN | 201782324 | U | 4/2011 |
| CN | 203572135 | U | 4/2014 |
| CN | 102113777 | B | 5/2014 |
| CN | 104145535 | A | 11/2014 |
| CN | 203934885 | U | 11/2014 |
| CN | 205813984 | | 12/2016 |
| CN | 207621131 | | 7/2018 |
| DE | 8909339 | U1 | 11/1989 |
| DE | 10020772 | C1 | 1/2002 |
| EP | 2090197 | A1 | 8/2009 |
| GB | 803789 | A | 10/1958 |
| GB | 2169791 | | 7/1986 |
| GB | 2284745 | | 6/1995 |
| JP | S4618350 | Y | 6/1971 |
| JP | S51123123 | U | 10/1976 |
| JP | H0965957 | A | 3/1997 |
| JP | 2002051852 | A | 2/2002 |
| JP | 2010269078 | | 12/2010 |
| RU | 2082307 | C1 | 6/1997 |
| RU | 8571 | U1 | 12/1998 |
| RU | 30249 | U1 | 6/2003 |
| RU | 134755 | U1 | 11/2013 |
| SE | 544174 | C2 | 2/2022 |
| TW | 1578884 | B | 4/2017 |
| TW | 1633859 | B | 9/2018 |
| WO | 9424440 | | 10/1994 |
| WO | 9427474 | A1 | 12/1994 |
| WO | 2004056236 | | 7/2004 |
| WO | 2016077717 | A1 | 5/2016 |
| WO | 2016176915 | A1 | 11/2016 |
| WO | 2019083632 | A1 | 5/2019 |

OTHER PUBLICATIONS

International Search Report issued in corresponding Application No. PCT/US2018/058598, mailed May 30, 2019.

Written Opinion issued in corresponding Application No. PCT/US2018/050781, mailed Feb. 14, 2019.

Written Opinion issued in corresponding Application No. PCT/US2018/058598, mailed May 30, 2019.

Extended European Search Report issued in corresponding European Application No. 18870845.7, mailed Jul. 5, 2021.

Final Office Action issued in corresponding U.S. Appl. No. 16/759,727, mailed Aug. 18, 2021.

First Office Action issued in corresponding Chinese Application No. CN201880020114.9, mailed Jan. 19, 2021.

Non-Final Office Action issued in corresponding U.S. Appl. No. 16/569,644, mailed Sep. 21, 2021.

International Search Report and Written Opinion for International Patent Application PCT/SE2021/050395 Mailed May 14, 2021.

International Search Report and Written Opinion from PCT/SE2021/050396 mailed May 19, 2021.

Search report from SE 2050497-3 dated Nov. 25, 2020.

Extended European Search Report issued in App. No. EP18933280, dated May 3, 2022, 6 pages.

International Search Report and Written Opinion received in Patent Cooperation Treaty Application No. PCT/SE2020/051246, dated Feb. 15, 2021.

International Search Report PCT/SE2021/050396 dated May 19, 2021, 5 pages.

Russian Office Action issued in App. No. RU20211067447/03, Jan. 10, 2022, 14 pages.

Written Opinion of the International Searching Authority PCT/SE2021/050396 dated May 19, 2021, 6 pages.

Office Action (Non-Final Rejection) dated Sep. 28, 2023 for U.S. Appl. No. 18/092,427 (pp. 1-18).

EPO Communication pursuant to Article 94(3) issued in App. No. EP18933280, dated Mar. 31, 2023, 6 pages.

* cited by examiner

STORAGE COMPONENTS FOR A CONFIGURABLE STORAGE SYSTEM

RELATED APPLICATION

This application, a national phase application of Patent Cooperation Treaty Application No. PCT/US2018/058598 filed Oct. 31, 2018, which claims priority to Patent Cooperation Treaty Application No. PCT/US2018/050781 filed Sep. 12, 2018.

This application is related to U.S. provisional application No. 62/730,524, filed Sep. 12, 2018, and is also related to PCT application number PCT/US2018/050781 filed Sep. 12, 2018, each of which is incorporated herein for all purposes.

FIELD OF THE INVENTION

The present disclosure relates to storage system components using cantilevered brackets mounted by vertical supports.

BACKGROUND

Conventional configurable, modular storage systems typically rely on cantilevered brackets connected to a vertical or upright element to support shelves, drawers, and other modular storage components having standard dimensions that can be assembled into any number of different configurations to accommodate space limitations and storage needs. The components that comprises these systems typically include a vertical standard that is attached to a wall using fasteners, hung from a track on a wall (sometimes referred to as a "hang standard"), or attached to a base or footing (an "upright"). Two or more vertical standards are placed or located a predetermined distance apart. Each standard has a plurality of slots to which the brackets can be attached. To support a storage component, at least one cantilevered bracket is attached to each standard. A cantilevered bracket is typically attached to a standard by inserting one or more hooks located on one end of the bracket, into slots formed in the standard. A hook can be formed in any number of ways, but in one example it is formed using a tab having a notch in a bottom edge of the tab, into which a bottom edge of a slot slides when the tab is inserted into the slot and pushed down.

A pair of cantilevered brackets connected on a vertical standard can be used to support one or more components for storing or organizing items or acting as work surfaces, such as shelves, baskets, sliding drawers, and any other type of component for storing, organizing and displaying clothing, clothing accessories, books, papers, files, equipment, and decorative and useful objects. These components will generically be referred to as "storage components." The end user selects and installs from a system's standard parts to assemble a combination of storage components that meets the user's needs and fits within the available space. Assembly is usually relatively easy and requires a minimal number of tools. The systems also typically allows for easy disassembly, adjustment, and re-use of parts to assemble different configurations. The components of such systems can also function as or be assembled to create desks, work surfaces, seating, and other furniture-like arrangements, depending on components and accessories that are available.

SUMMARY

The following specification discloses embodiments of a storage system using cantilevered brackets mounted to vertical support members to support storage components.

Prior art brackets may, for example, use pairs of horizontally displaced hooks to stabilize the cantilevered bracket or structural member extending from the sides of the bracket at its connection interface to the vertical standard to act against the vertical standard. However, such approaches result in a wider bracket that cannot be easily hidden or incorporated into an aesthetically pleasing design, and they tend to prevent more than one bracket from being connected to the same standard.

In one aspect of the disclosure, storage components for a storage system are supported on vertical standards with thin cantilevered brackets that would otherwise tend to swing when hung on a vertical standard using a single column of one or more hooks inserted into a column of slots on the vertical standard. Despite the tendency of such brackets to swing when attached to the vertical standard, the cantilevered brackets are constructed and support the storage components in a sturdy and aesthetically pleasing manner that allow, if desired, more than one bracket to be connected at same level to the same standard.

Aspects of the various embodiments of the storage components described below retain ease of assembly from standardized parts with standardized dimensions using a minimal number of tools, as well as flexibility in arranging storage components to fit an available space and meeting the needs of a user that are characteristic of prior systems. Each of these aspects, singly and in combination with one or more of the other aspects, allow for or contribute to improved mechanical rigidity and strength and improved aesthetics as compared to prior systems.

DETAILED DESCRIPTION

Figure 1:
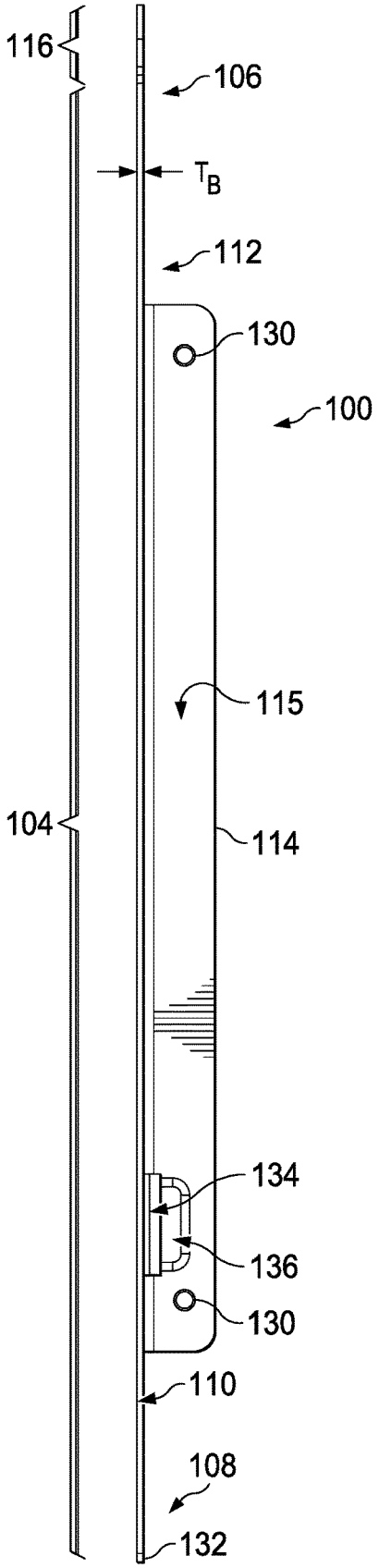
FIG. 1 is a top view of a cantilevered bracket for connecting with a vertical standard for supporting a shelf.
Figure 2A:
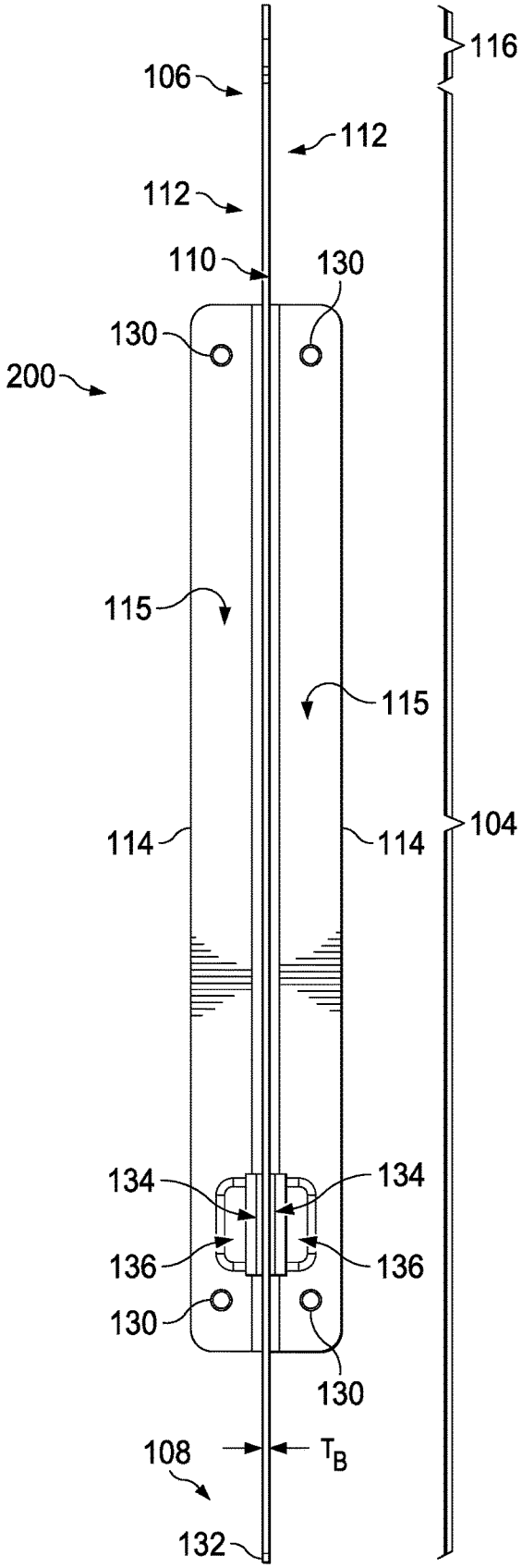
FIG. 2A is a top view of a second embodiment of cantilevered bracket for connecting with a vertical standard for supporting a shelf.
Figure 2B:
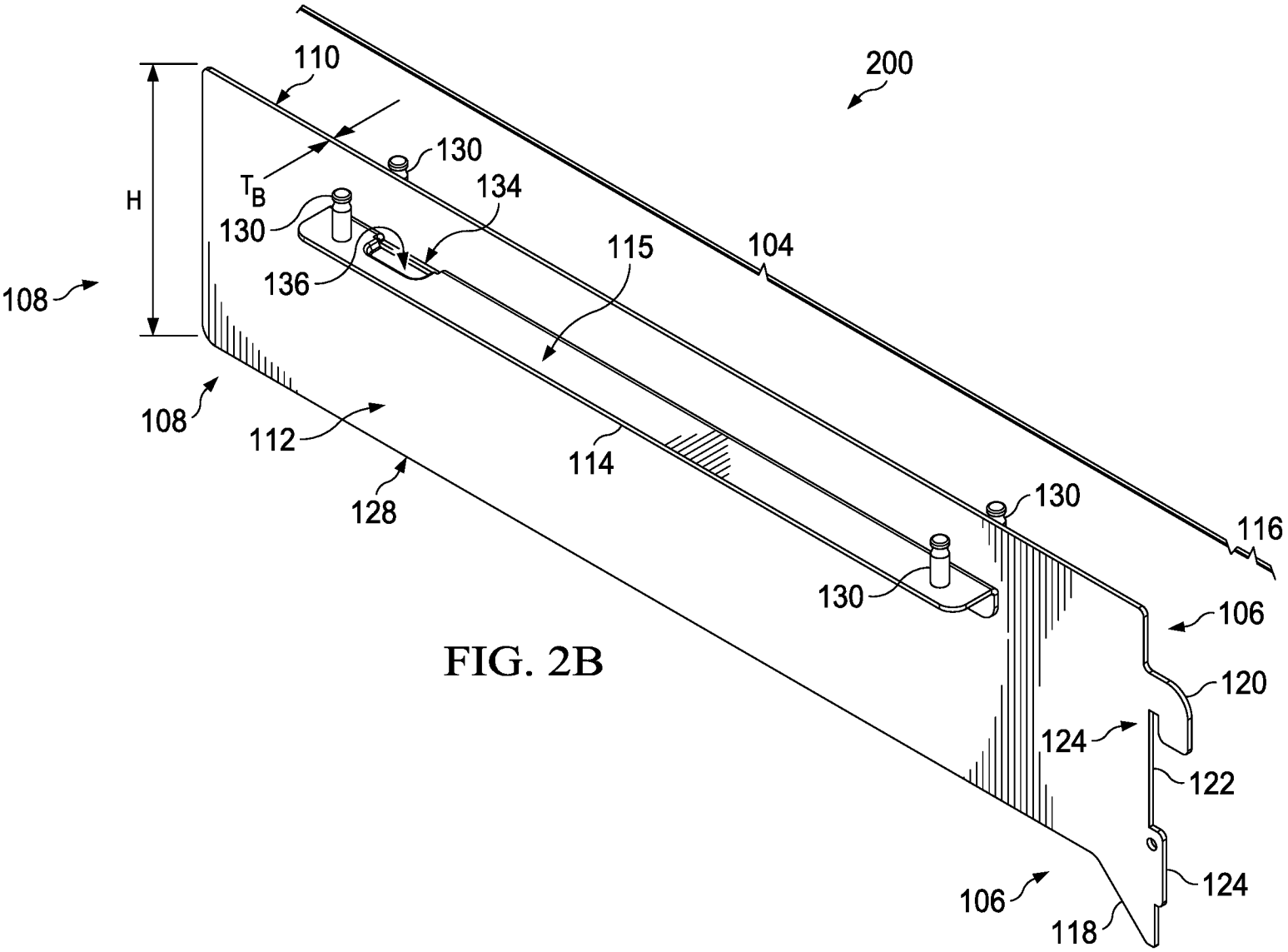
FIG. 2B is a perspective view of the cantilevered bracket of FIG. 2A.

In the following description like numerals refer to like elements.

The following description contemplates a storage or organization system comprising modular storage components that can be assembled into a number of different configurations depending on the needs of the end user and available space. The system includes standards that are held in a vertical orientation and cantilevered brackets that are connected to the vertical standards by a mechanical joint which will be referred to as an interface or connection interface. Although described with reference to representative examples of storage systems in which they may be used to particular advantages, the storage components described below can be adapted to other types of modular storage systems that make use of cantilevered brackets, including systems that are not wall mounted and that use vertical standards of different construction.

In the representative storage systems described below, the standards are supported in a vertical orientation. To connect the standard to a wall it can be fastened to the wall with any type of fastener—a screw, bolt, or nail, for example—held against the wall by one or more clips or brackets that are connected to the wall or hung from one or more cleats or rails that are connected to the wall. However, other ways of supporting the vertical standards could be used. For example, a base on the floor or bracing that extends from the floor, walls and/or ceiling, could be used alone or in combination to support standards. The vertical standards could also be supported at each end by a floor and a ceiling. Once the standards are placed, such systems usually, but need not always, allow reconfiguration of the storage components and the addition of new components. Non-limiting examples of components include shelves, drawers, cabinets, baskets, racks, desks, and hooks. However, such systems may include many more types of components and accessories that can be connected to the standards or otherwise supported by the brackets connected to the standards.

The size of each standard is long in one dimension and narrower and shorter, relative to its length in the first dimension, in each of the other two dimensions. Each of the standards will usually have on its front regularly spaced openings, for example, slots spaced at one or more uniform intervals, into which a horizontally extending piece of a cantilevered bracket's connection interface is inserted. Each cantilevered bracket is, usually, comprised of an elongated support member extending forwardly from a connection interface that includes a means by which it can be joined or connected to a vertical standard. The bracket's connection interface is configured to interfere with the standard to prevent the bracket from pivoting and translating downwardly once it is connected with a vertical standard. The connection interface may include one or more rearward extensions that are inserted into one or more corresponding openings on the vertical standard. The bracket is then moved or rotated to a locked position. A number of different configurations of the extension are possible and have been used to join cantilevered brackets to vertical standards in a manner that allows connection and removal of the cantilevered bracket without the aid of a tool or additional fastener. The connection interface allows for placement and, if desired, repositioning of the brackets to support different configurations of storage elements. Examples of such means for joining a bracket to a vertical standard include a horizontal member that is formed to resemble, in cross-section, a hook with a horizontal component that interferes with the standard to prevent vertical translation of the bracket and a vertical component that interferes with the standard to prevent pivoting and to transfer the moment created by a load on the horizontal support member of the bracket.

To install a typical, wall-mounted storage system, two vertical standards are mounted at predetermined distance from each other. A system may have one or more standard separation distances that correspond to the width or widths of its standard storage components. Some specific, non-limiting examples of such a system are described below. A cantilevered bracket is then connected at corresponding heights on each vertical standard so that they are level. A storage component such is then mounted between the brackets. Multiple storage components can be mounted to form a column or stack of two or more storage components by connecting additional pairs of brackets at different heights. The system can be expanded by adding another standard, allowing for two columns of storage components arranged side-by-side.

Figure 6:
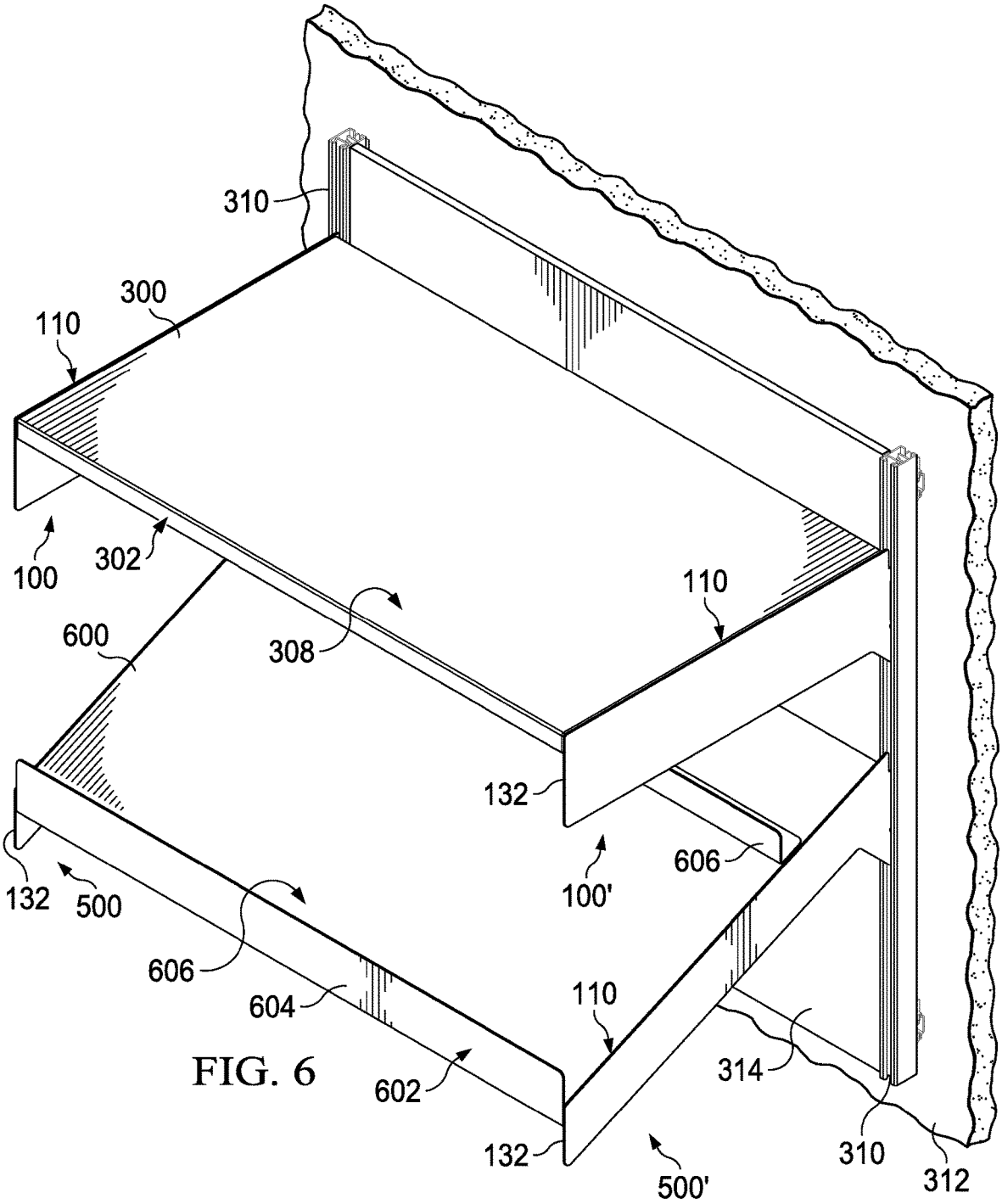
FIG. 6 is a perspective view of a representative, non-limiting example of an installation of a wall mounted storage system with a horizontal shelf illustrated in FIG. 3D and a slanted display shelf mounted on the same set of vertical standards.

FIGS. 1, 2A-2B, 3A-3D, 4A-4D, 5 and 6, illustrate representative examples of cantilevered brackets 100, 200, and 500 for use in a storage system for supporting shelves and similar components. Representative examples or embodiments of shelves include horizontal shelf 300 and slanted shoe shelf 600. Cantilevered brackets 100' in FIGS. 3A-3E and 4A-4C is a mirror image of bracket 100. Similarly cantilevered bracket 500' in FIG. 6 is a mirror image of bracket 500. Only brackets 100 and 500 will be referred to in the subsequent description, but the description is applicable to both versions. Each cantilevered bracket 100, 200 and 500 is comprised of elongated support 104 having a length between a proximal end 106, where the bracket connects to a vertical standard 310, and a free, distal end 108 that projects outwardly from the vertical support. The elongated support 104 portion of brackets 100 and 200 projects horizontally but at an obtuse angle in cantilevered bracket 500. The elongated support 104 portion has a top edge 110 and a support ledge 114 along at least one of two side surfaces 112 of the elongated support 104. Embodiments 100 and 500 have a support ledge on one side; embodiment 200 has two support ledges, one on each side surface 112.

Each support ledge is located on the side surface 112 at a position that is lower than the top edge 110. The distance between the top edge 110 and an upper surface 115 of the support ledge 114 remains, in the embodiments shown in the drawings, substantially or uniform or constant along the length of the support ledge 114. Thus, the plane of the upper surface 115 of each ledge 114 is parallel to the top edge 110. This distance is, in a one, preferred embodiment, equal to a thickness of a shelf Ts so that a top surface 308 of shelf 300 and top surface 606 of shoe shelf 600 is aligned or flush with the top edge 110 when either of the shelves are supported by a ledge 114. In this embodiment, the upper surface 115 of the ledge 114 forms a right angle with the portion of the side surface 112 from which the ledge extends. The upper surface 115 and the portion of the side surface 112 between the ledge 114 and top edge 110 is substantially flat or planar (without visually perceptible curvature to an ordinary observer) where the side and bottom surface of the shelf (side 304 and bottom surfaces 306 of shelf 300, for example) engage the side surface 112 of the bracket and upper surface 115 of the ledge. This allows the shelf to fit close to or against both the ledge and the bracket in order to form a neat appearance and, optionally, to restrict shift of the shelf relative to the bracket in at least two directions or degrees of freedom of movement.

Although it is advantageous for the portion of the side surface 112 that is above the upper surface 115 to be flat and oriented vertically (when installed on a vertical standard) to receive a shelf, such as shelves 300 and 600, with flat side and top surfaces at right angles, an alternative embodiment may have at least these portions of side surfaces 112 slanted, curved or shaped in a manner that is complimentary to the side of the shelf. Furthermore, in alternative embodiments the side surfaces 112 could be made non-planar and/or not parallel to each other while still maintaining a thin profile as seen from the distal end of the brackets 100 and 200.

Although ledge 114 is shown as a single element that is attached to the side surface, in alternative embodiments the ledge could comprise two or more segments that are separated and, optionally, spaced apart to support the shelf. Using one, single ledge offers the advantage of simplified fabrication of the cantilevered. References to a "ledge" in the description and claims contemplate and are intended to refer to either a unitary or a segmented ledge unless specifically indicated otherwise.

Each of the brackets 100 and 100' (FIGS. 3A-3D, and 4A-4D) and 500 and 500' (FIG. 6) is connected in a cantilevered fashion to one of the vertical standards 310. A connection portion 116 comprises at least one rearward extension 120 and back edge 122. The rearward extension acts, when inserted into a slot or opening (not visible) in a vertical standard and set in a locked position, to retain the bracket on a vertical standard by preventing translation in-and-out, side-to-side, and downwardly with respect to the slot. A downward shift of the extension after the insertion locks or sets the connection and an upward shift unlocks it and allows it to be removed in this example. The rearward extension 120 and back edge 122 also cooperate to transfer to the vertical standard the moment caused by a load on the cantilevered bracket. The top edge 110 in the embodiments that support a horizontal shelf, such as cantilevered brackets 100 and 200, will be perpendicular to back edge 122. In embodiments in which the elongated support is slanted with respect to the vertical standard, such as cantilevered bracket 500, the top edge 110 will extend at an oblique angle relative to the back edge.

Although several different arrangements are possible, in this example rear extension includes a slot 124 that receives a lower transverse edge defining the opening or slot in a front wall of the vertical standard 310. The extension thus forms a hook-like portion that, when in a locked position, cooperates with an inside surface (not visible) of a front wall of the vertical standard below the opening in which the rearward extension is inserted. In alternative embodiments, the rearward extension could instead include, for example, a portion that extends upwardly from an end of the rearward extension to catch an inside surface of the front wall of the vertical standard above the opening.

The connection portion 116 also includes a second rearward extension 126 that is below the first one and is optional. It cooperates with a lower slot (not visible) on the vertical standard and acts primarily to maintain vertical alignment of the bracket with the vertical standard. In this example, pushing the rearward extension 120 down to lock it aligns the tab-like rearward extension 126 with the lower slot, allowing it to enter the slot. The dimensions and location of the tab may be chosen to allow its upper edge to cooperate with the top edge of the slot to help to prevent unintended upward shifting of the bracket after it is in a locked position. Depending on its size, it may also be used to transfer some of the load on the cantilevered bracket to the vertical standard. A lower extension 118 extends the back edge 122 to below the bottom edge 128 of the elongated member 104. The extension accommodates the second rearward extension 126, the bottom of which is below the bottom edge 128 of the elongated member. The spacing between the rearward extensions 120 and 126 is the same as, or a multiple of, the spacing between the slots on the vertical standard.

The elongated support 104 is, in this example, fabricated or cut from a single sheet or plate of rigid material such as steel or other metal that is oriented vertically so that one edge of it forms the top edge 110 of the bracket. The sheet has a uniform thickness $T_B$. The elongated support 104 thus has a uniform thickness. The top edge 110 and the bottom edge 128 of the elongated support 104 are parallel. However, in alternative embodiments, they need not be. The elongated support 104 thus has a height H that is consistent along the length of the elongated support 104 portion of the bracket except for corners and where the support transitions to the connection portion 116 of the bracket. Lower extension 118 is an example of the height of the bracket changing near the transition of the elongated support 104 to the connection portion 116. The connection portion 116 of the bracket can be formed from the same sheet of materials by cutting it to form the rearward extensions 120 and 126, as well as the lower extension. Thus, the entire bracket, except for the ledges 114, can be cut from a single sheet of material. The thickness and other dimensions of the bracket are sufficient to resist bending, twisting or other deformation when the proximal end is connected with a vertical support and is subjected to a maximum expected or rated load from a storage component and its contents supported by the bracket.

Figure 3A:
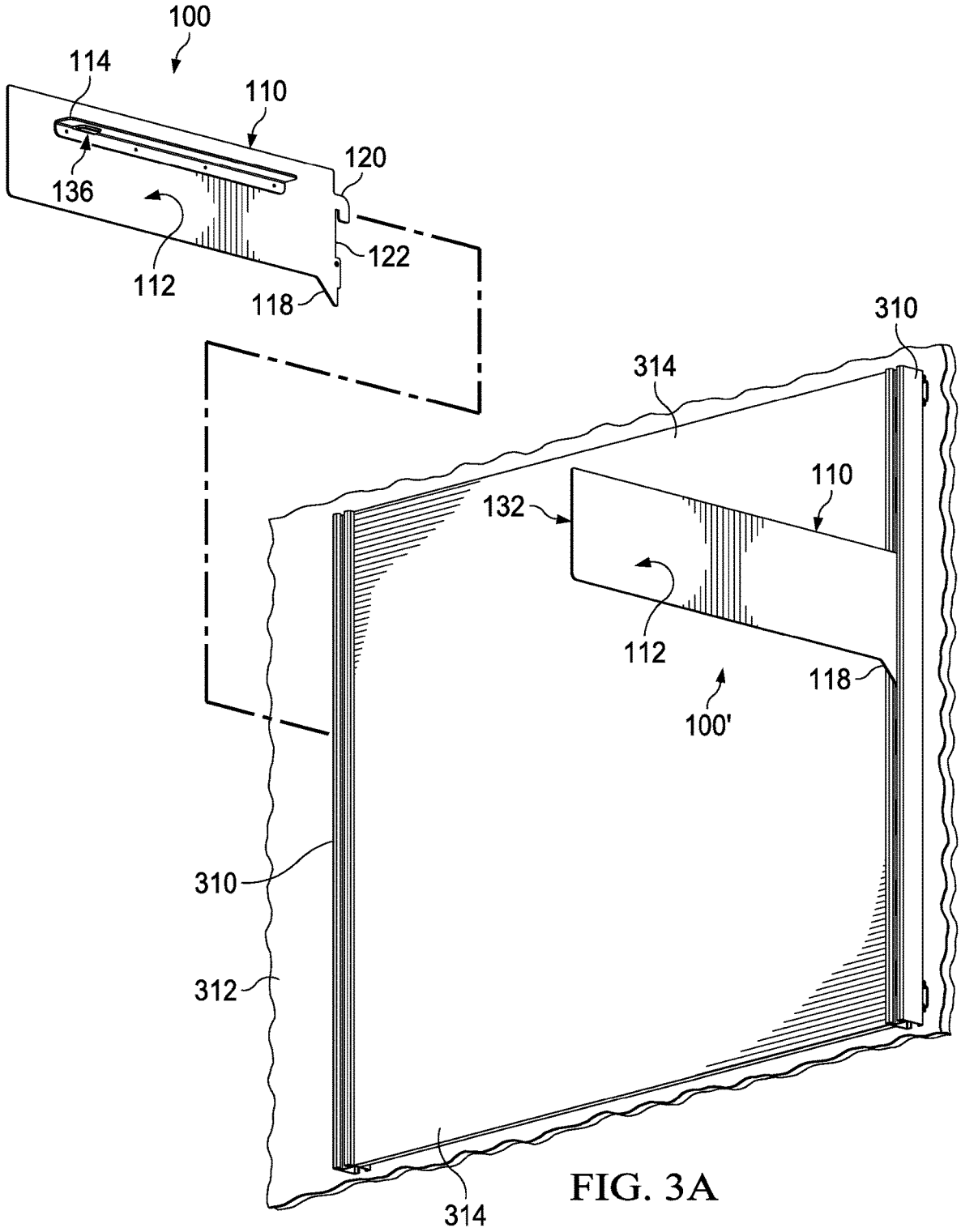
FIGS. 3A to 3D are perspective views illustrating a process of installing a shelf of a well mounted storage system at successive stages.
Figure 3B:
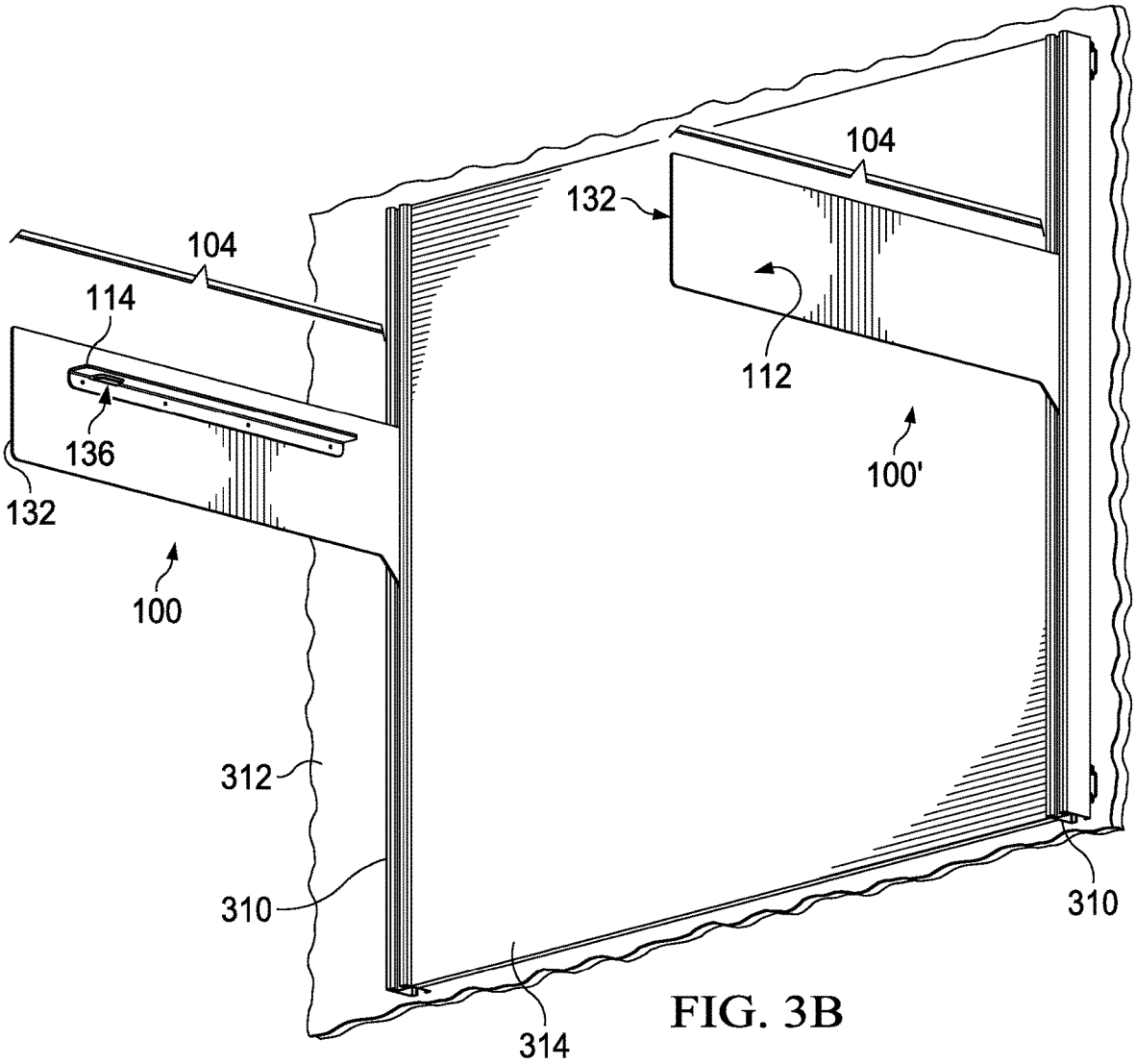

Examples of the material from which the elongated support element can be made include metals, such as steel, plastics, and composites materials. Each ledge 114 are, in the example, formed from a "L" shaped piece. One portion of it is placed against and attached to the side surface with the other portion extending outwardly. Assembly of a shelf component of a storage system using the cantilevered brackets 100 and 100' is illustrated by FIGS. 3A-3D. The two vertical standards 310 are representative examples of vertical standards. They are connected to a wall 312 and separated by a distance determined by the width of shelf 300. Each shelf has, in this example, a standard width and depth for storage components in the storage system. Between the standards is installed an optional panel 314, which gives the system a finished look that makes the panels appear recessed. Brackets 100 and 100' are connected at the same level to each of the standards 310, as shown in FIGS. 3A and 3B. The shelf is then inserted between the brackets 100 and 100' and rests on the uppers surfaces 115 of the ledges 114. As indicated by FIG. 6, slanted shoe shelf 600 has the same standard width as shelf 300 and extends forwardly to the same point. It is installed in a similar fashion.

Extending upwardly from the upper surface 115 of each ledge is at least one post 130. The posts extending in a direction normal to the upper surface. In the illustrated examples, there are two posts 130, and there can be more if desired. The posts 130 are inserted into pockets or openings 314 formed through the bottom surface 306 of shelf 300 and the bottom (not visible) of shoe shelf 600. There are at least the same number of openings as posts, though there can be more openings than posts. Thus, there are at least two openings, one on each end, of the shelf. The posts and pockets are aligned such that the sides 304 of the shelf 300 closely fit against the side surfaces 112 of the elongated supports 104 of the brackets 100 and 200 and the front side surface 302 of the shelf 300 has a predetermined relationship with a front edge 132 of the elongated support 104. Similarly, a front surface 604 of the shoe shelf 600 also has a predetermined relationship with the front edge 132 of bracket 500. The top surfaces 308 and 606 of the shelves 300 and 600 also have a predetermined relationship with the top edge 110 of the brackets 300 and 500. That relationship is determined by the position of the ledge 114 relative to the top edge 110 and the thickness of the shelf. In one embodiment, the predetermined relationship of the top surface and the front side surface of the shelf with the top and front edges of the bracket are that they are aligned or flush with each other. However, in alternative embodiments, the posts and openings can be aligned to create a different relationship between the front side surface 304 and the front edge 132 of the elongated member. The predetermined relationship of the top surface 302 and the top edge 110 can also be changed is something other than a flush arrangement is desired.

The shelves 300 and 600 may incorporate in the openings a locking mechanism that cooperates with the posts to retain or lock the shelf on the posts. One example is a cam lock nut that is comprised of a cam surface that engages a shoulder formed by a waist on the post. When rotated, the cam acts against the shoulder and pulls the shelf down the post and locks it. The locking increases the rigidity of the connection between the shelf and the bracket.

Posts 130 may be omitted in alternative embodiments. However, they offer the advantages noted, and offer particular advantage when used with brackets such as 100 and 200 that are connected to a vertical standard using a single hook. A cantilevered bracket with a single connection point will tend to swing side-to-side, especially when it is connected with an embodiment of a vertical standard with slots is wide enough to accommodate hooks from two, abutting brackets. Conventional approaches of stabling swinging such as the use two hooks and a double column of slots on the vertical standard, or a flange or other stabilizing structural member to resist swinging, will typically result in a wider, less attractive bracket. Connecting the shelf to the bracket with posts 130 will tend to prevent or reduce the swinging of brackets 100 and 200.

If side-by-side shelves at the same level are desired for an installation, a third vertical standard can be mounted and cantilevered bracket with ledges 114 on each side can be placed on the middle standard, thereby enabling a single, thin profile bracket to be used to support the end of two shelves. Cantilevered bracket 200 is an example of such a bracket for a horizontal shelf. However, alternatively, because of their thin profiles, the cantilevered brackets with a single ledge could also be inserted into the same set of slots on the same vertical standard, with their respective side surfaces 112 that do not have ledges abutting each other.

The construction of the cantilevered brackets and manner and means by which they support shelving allow for a thin profile and more aesthetically pleasing shape that fit better with the shelf. This results in improved aesthetics and rigidity that reduces movement and rattling of the components that prior systems exhibited, while maintaining ease of installation. The result is a highly configurable storage system that appears and feels similar to furniture or custom or "built in" shelving. Other storage components with a planar member that can be supported between two brackets can be substituted for the horizontal shelf.

FIGS. 4A-D illustrate an optional feature that may be used in combination with the shelf and brackets described in FIGS. 3A-3D: a closet rod located below the shelf 300. Installation of the closet rod does not require additional fasteners or tools and is accomplished during the assembly of the shelf. To support closet rod 400 a pair of hanging brackets 402 are used. Each hanging bracket has a closet rod holder 404 that is, in this example "U"-shaped that is open at the top and one side to receive one end of the closet rod 400. The sides of the holder are, optionally, attached only to a bottom wall of the holder, which extends at a right angle from strap 406, and biased slightly inwardly. This allows the sides to deflect outwardly slightly when inserting one end of the closet rod and then to pinch against the end of the rod once inserted. To make it easier to insert the closet rod between the sides, the top edge of side is angled outwardly. The closet rod has, optionally, a non-circular cross section, with one or more flattened surfaces. The illustrated example has a cross-section that is rectangular with rounded corners.

Figure 3C:
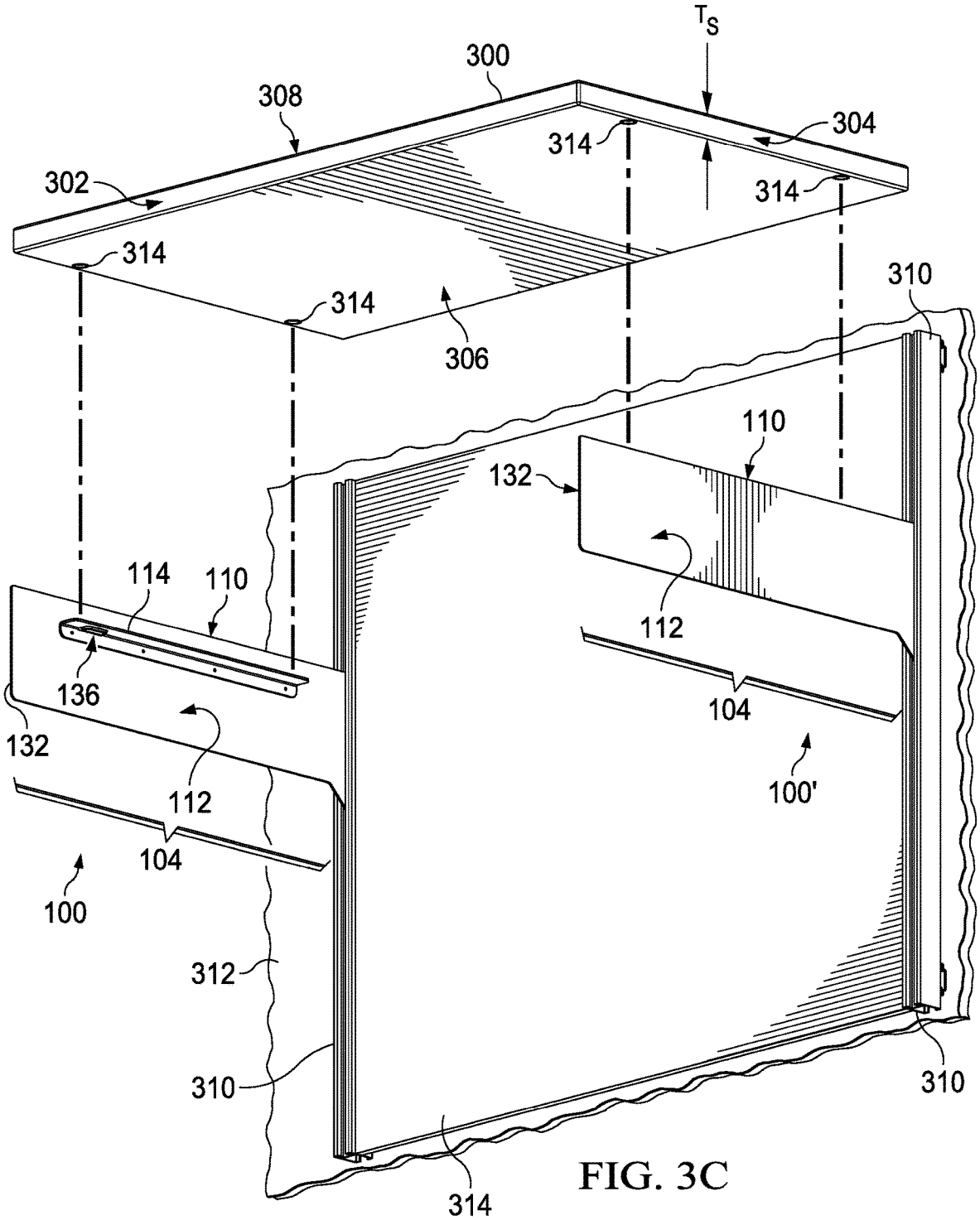
Figure 3D:
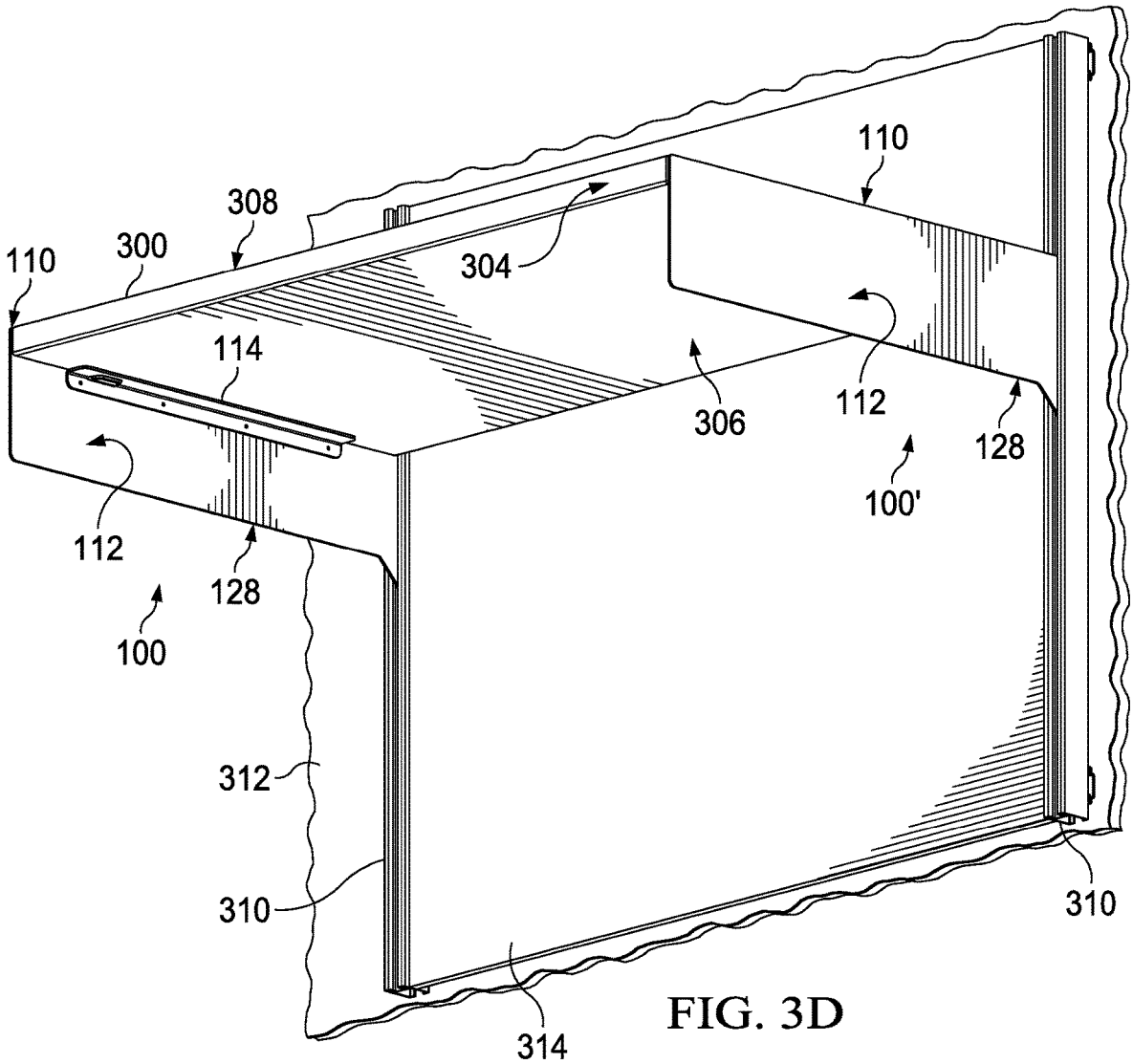
Figure 4A:
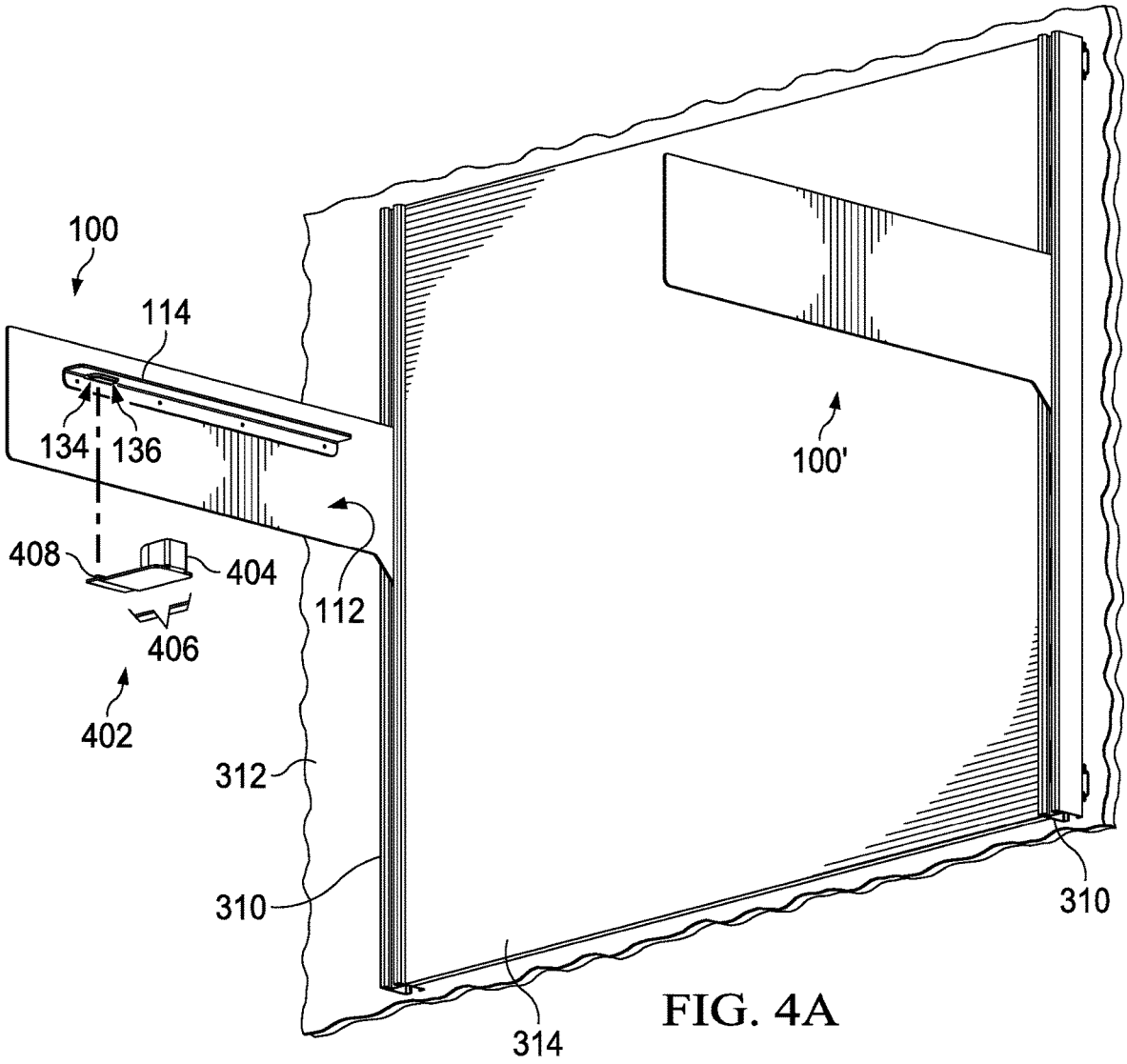
FIGS. 4A to 4D are perspective views of a process of installing a closet rod as part of the process of installing the shelf illustrated by FIGS. 3A to FIG. 3D.
Figure 4B:
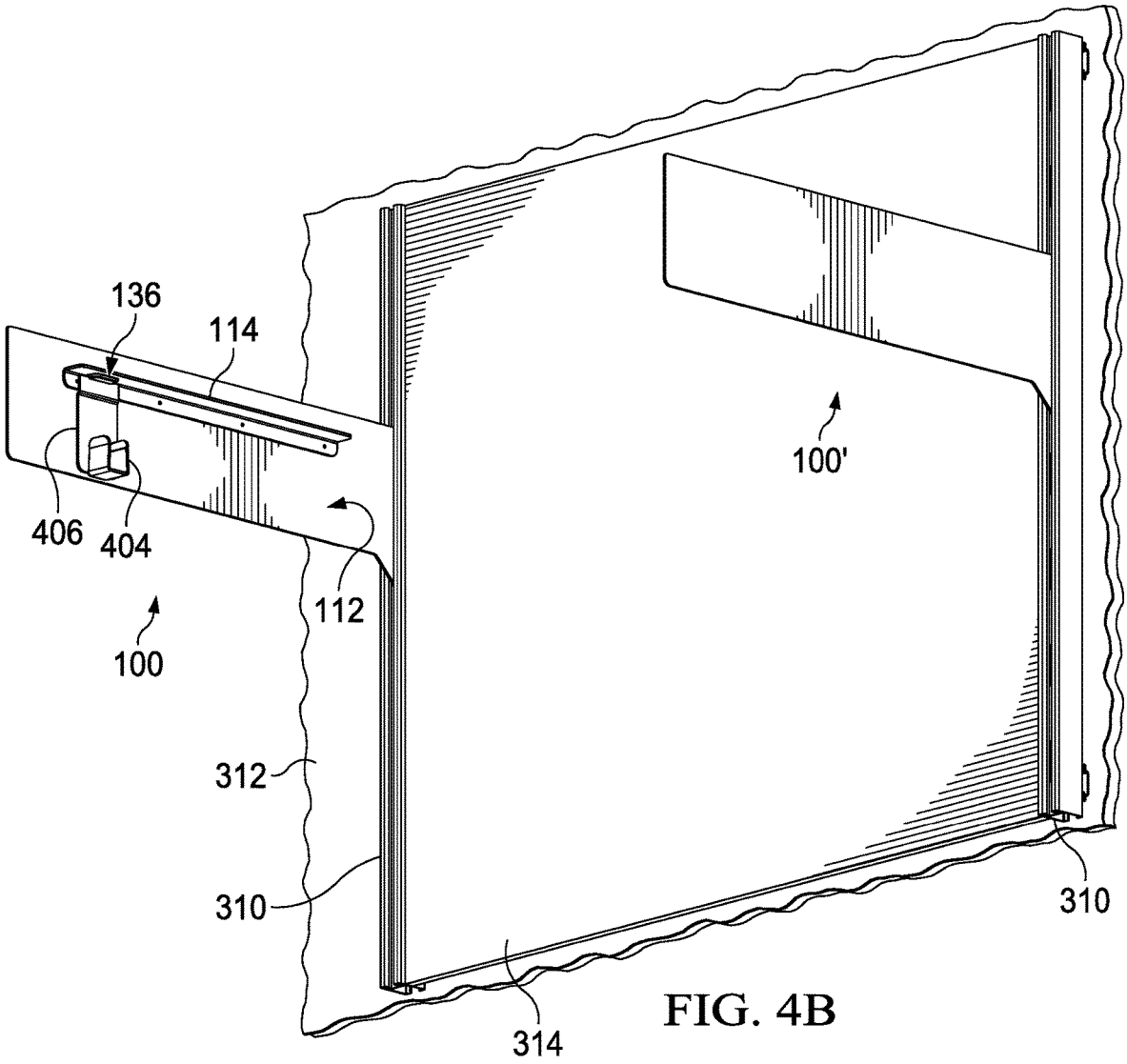
Figure 4C:
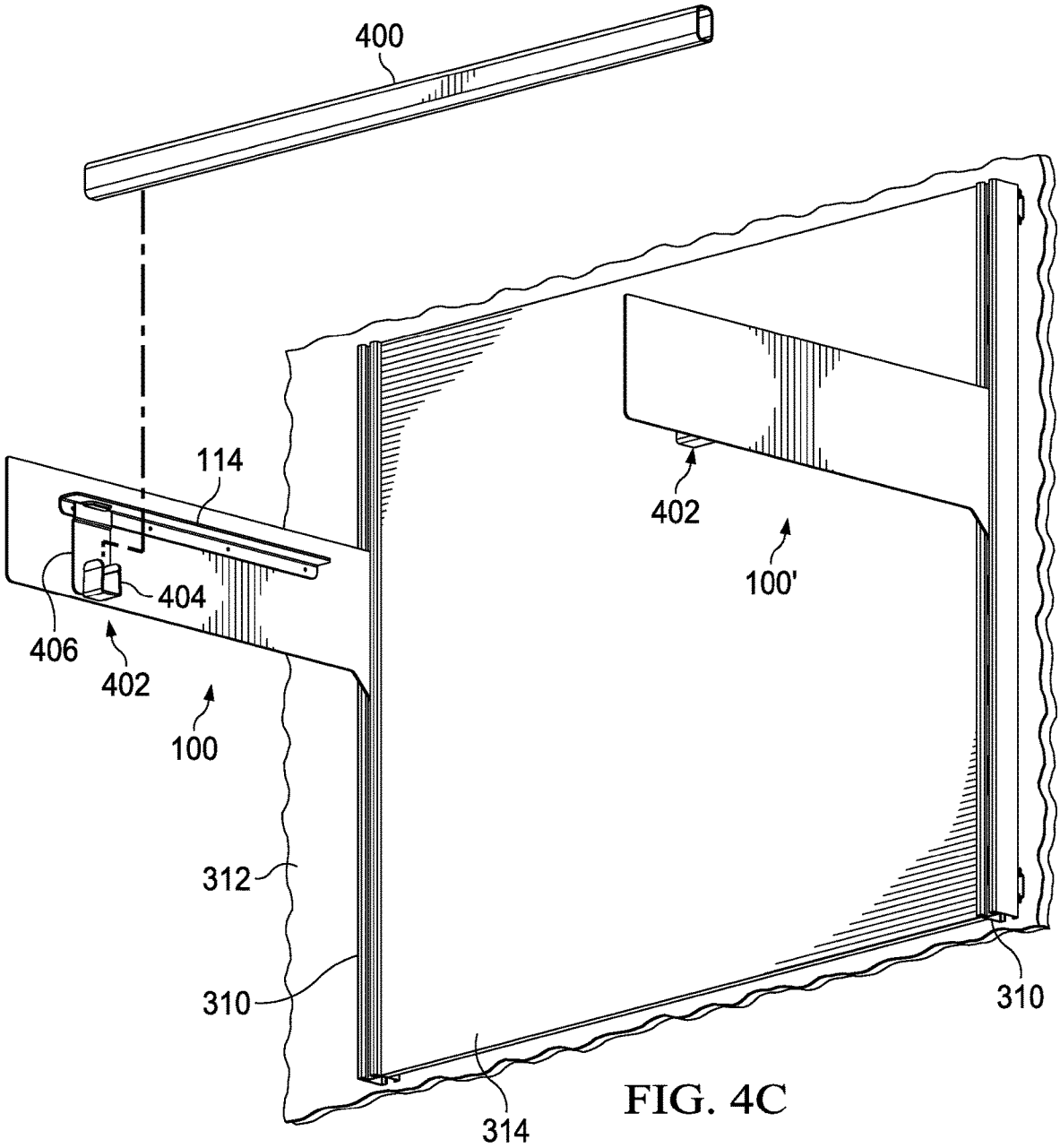
Figure 4D:
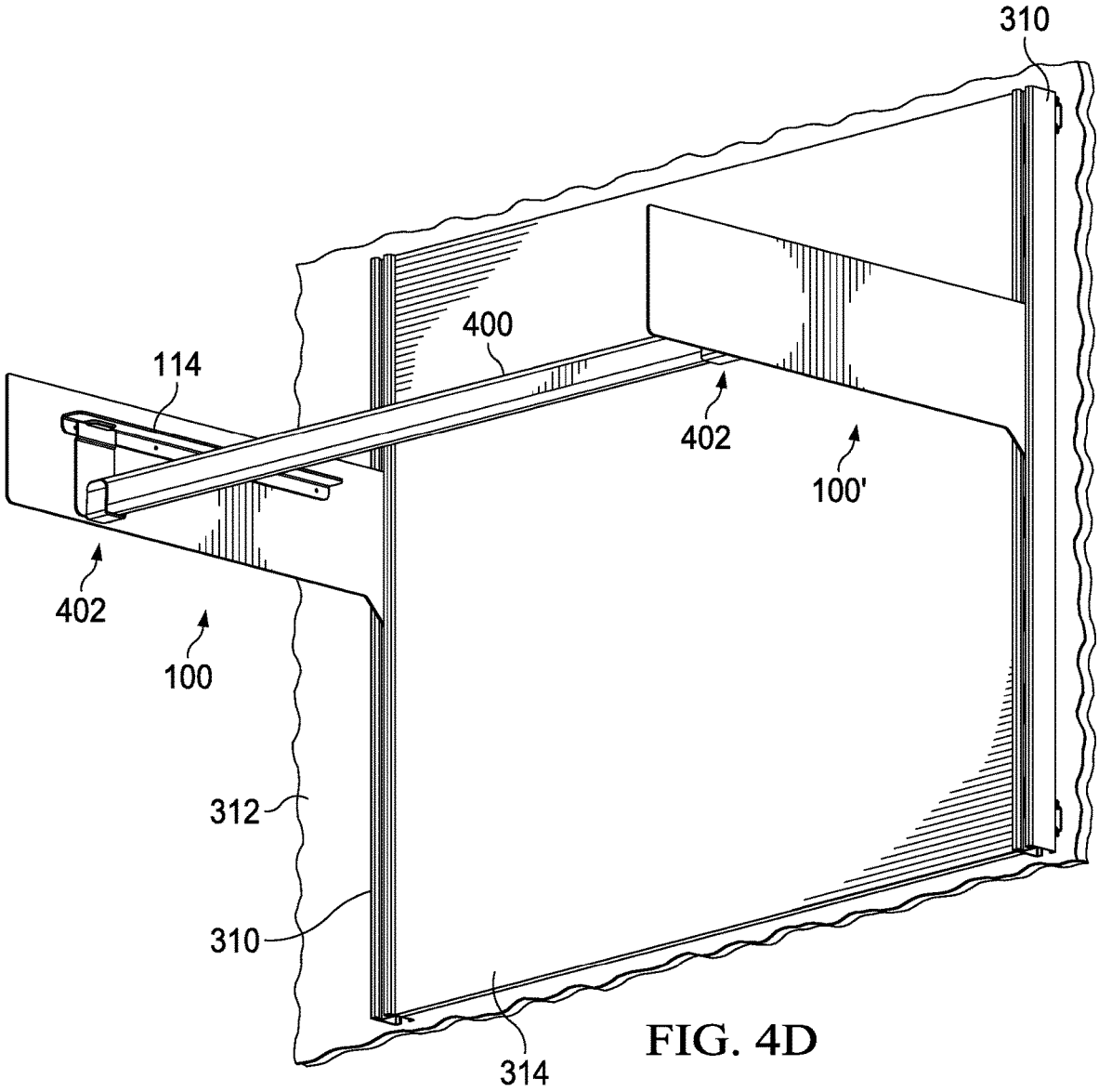
Figure 5:
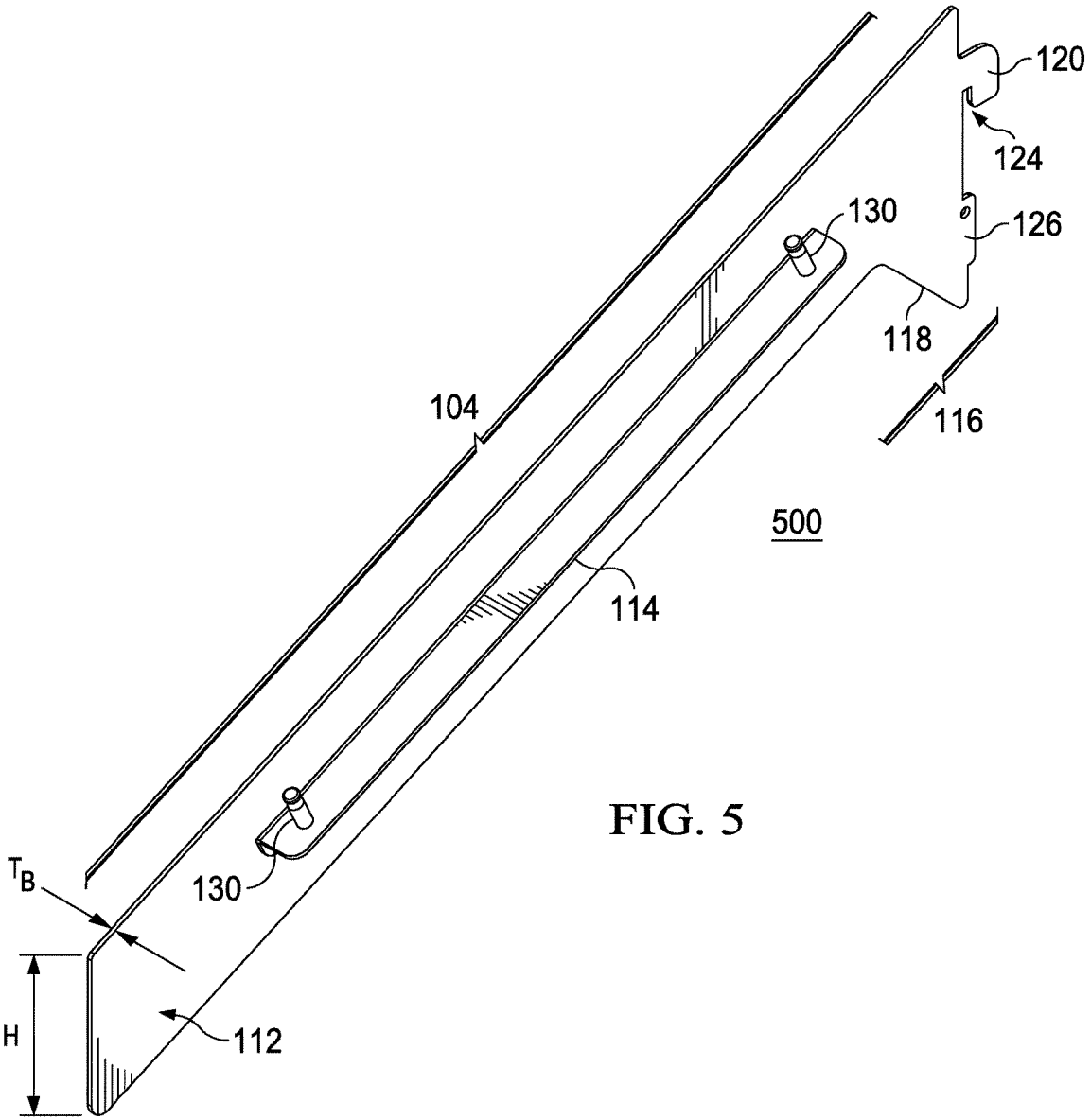
FIG. 5 is a perspective view of an alternative embodiment of a cantilevered bracket for supporting a slanted surface on a wall mounted storage system.

The holder 404 is hung from the ledge 114 of the cantilevered brackets 100 and 200 by the strap 406 and a tab 408 that is at a right angle at the top of the strap. Each hanging bracket is installed by passing the tab 408 through a slot 134 formed between the ledge and the side surface 112 to which it is attached, and then pivoting the hanging bracket 402 so that the tab 408 moves into a depression 136 formed in the upper surface 115 of the ledge and the extension 406 is against the side surface 112 of the cantilevered bracket. The depression accommodates the tab so that it does not interfere with a shelf when installed on the ledges of the bracket. The extension 406 and tab 408 acts like a hook to transfer the load of the closet rod to the ledge 114 and thus also to the cantilevered bracket. Two hanging brackets are installed, one on each of the pair of cantilevered brackets that supports the shelf under which the closet rod will be installed. Once the pair of hanging brackets are installed, the closet rod is inserted into the holders as shown in FIGS. 4C and 4D. The rod, in effect, locks the hanging brackets so that they cannot move or pivot. The shelf is then installed as shown in FIGS. 3C and 3D.

In one embodiment, the holder 404 and tab 408 are made of a rigid material that tends not to deform under expected loads, with the joint of each of the holder 404 and tab 408 the strap 406 also being rigid to maintain right angles with respect to the side surface 112 when the closet rod hanger is installed. The strap may also be made of rigid material or permitted to flex to some degree. The rigid materials may be made of metal or plastic. The hanger is, in one embodiment, integrally formed using an injected plastic molding process.

Referring now briefly just to FIG. 6, the arrangement that is shown in the figure is intended to be a representative, non-limiting example showing how multiple shelves can be installed on the same pair of vertical standards 310. This example includes horizontal shelf 300 and slanted shoe shelf 600, with a front toe stop 604 on the front side of the shelf and a rear heal stop 606. Examples of other types of arrangements include two or more horizontal shelves 300, two or more shoe shelves 600, or any combination of them and any other components. Furthermore, other types of storage components having a structural component like a shelf could be substituted for shelves 300 and 600 and be supported on a cantilevered bracket like cantilevered brackets 100, 200 and 600. Shelves can be made from wood, wood laminates, metals, plastic, composite materials, and combinations thereof.

Figure 7A:
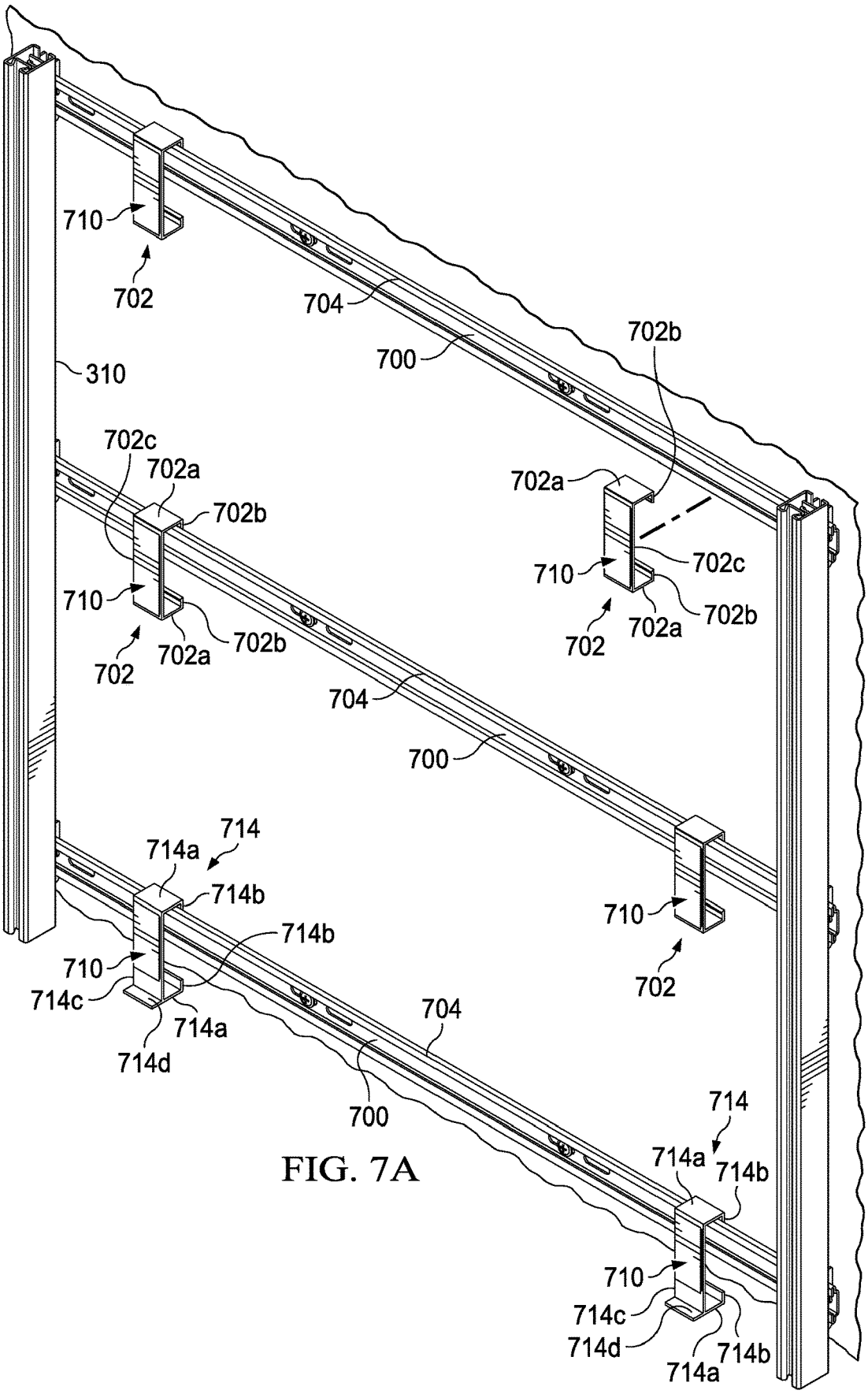
FIG. 7A is a perspective view of a wall mounted storage system in a first stage of an installation of a back decorative panel.
Figure 7B:
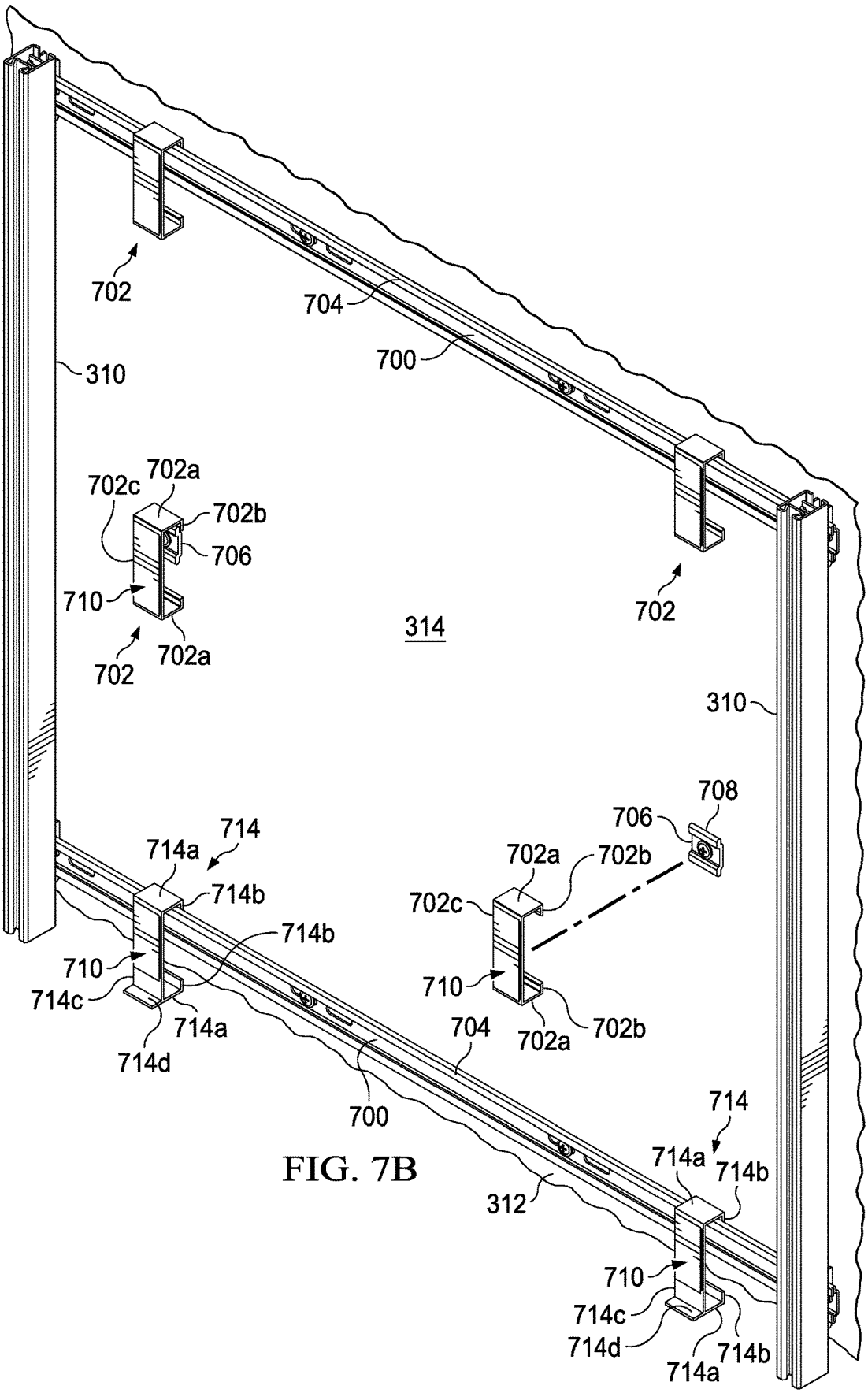
FIG. 7B is a perspective view of the wall mounted storage system of FIG. 7A showing an alternative method of attaching brackets for the back decorative panel.
Figure 7C:
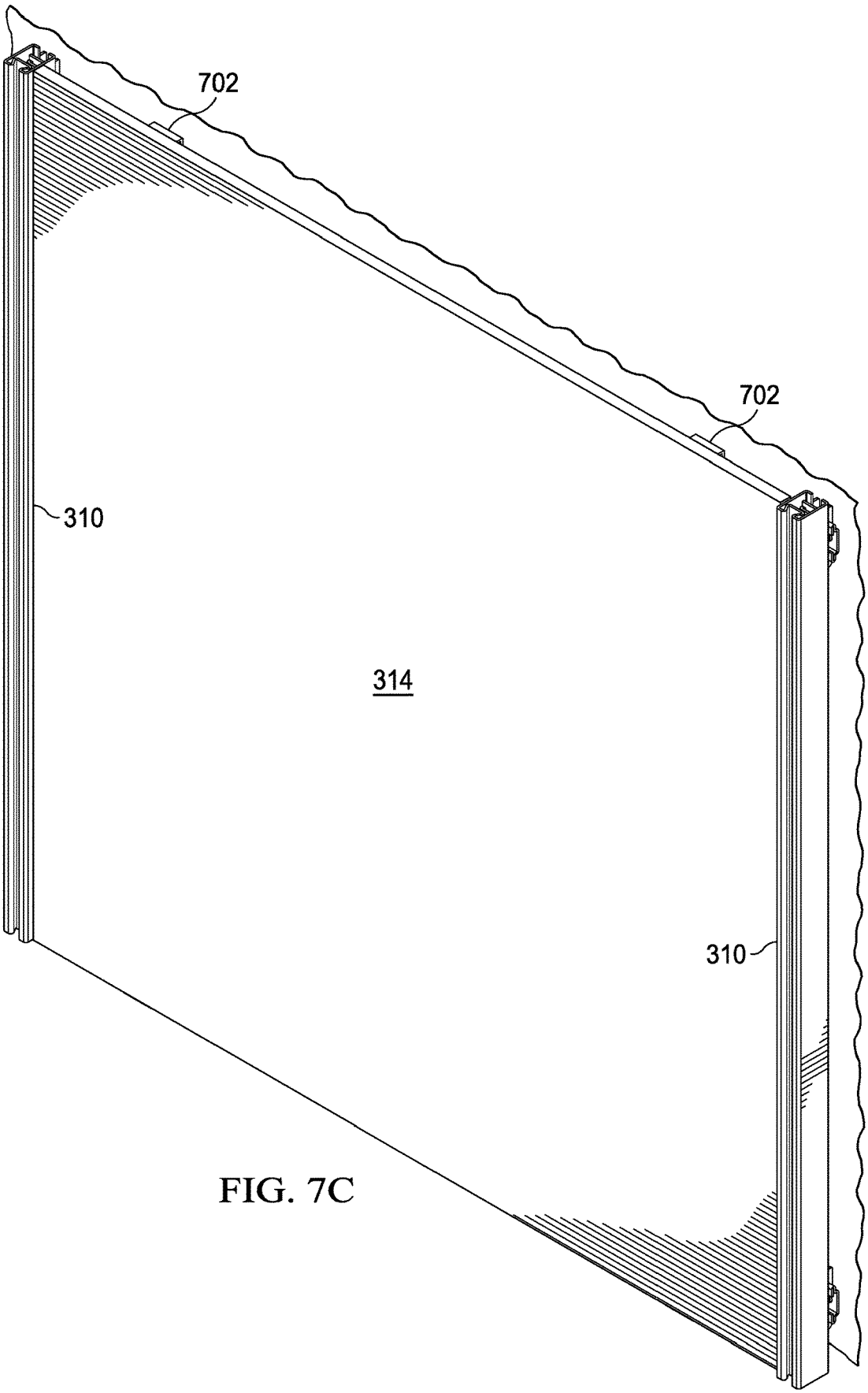
FIG. 7C is a perspective view of the installation of the wall mounted storage system of FIG. 7A or 7B with the back decorative panel attached.
Figure 8A:
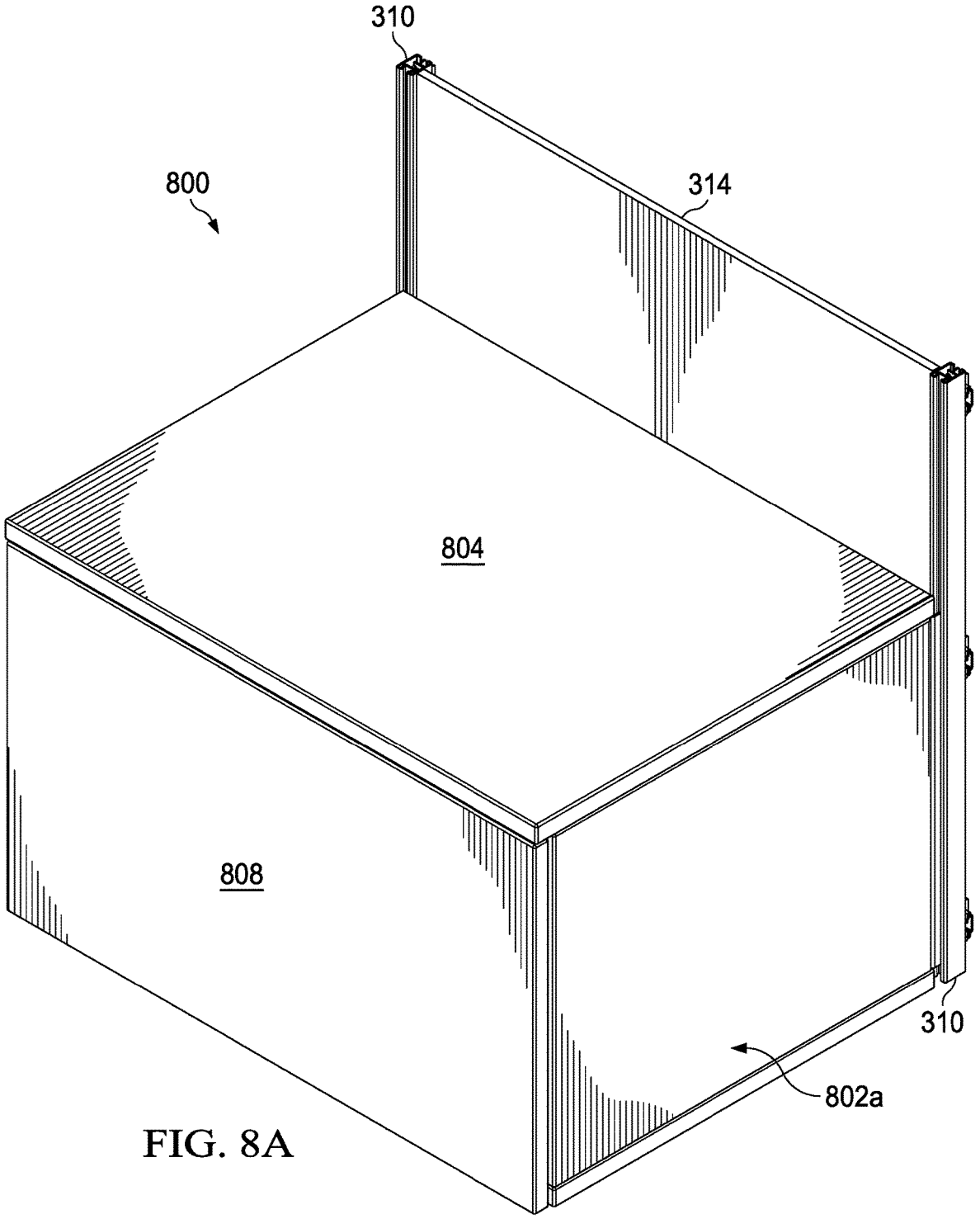
FIG. 8A is a perspective view of a drawer mounted to a wall mounted storage system like the one shown in FIG. 7C.
Figure 8B:
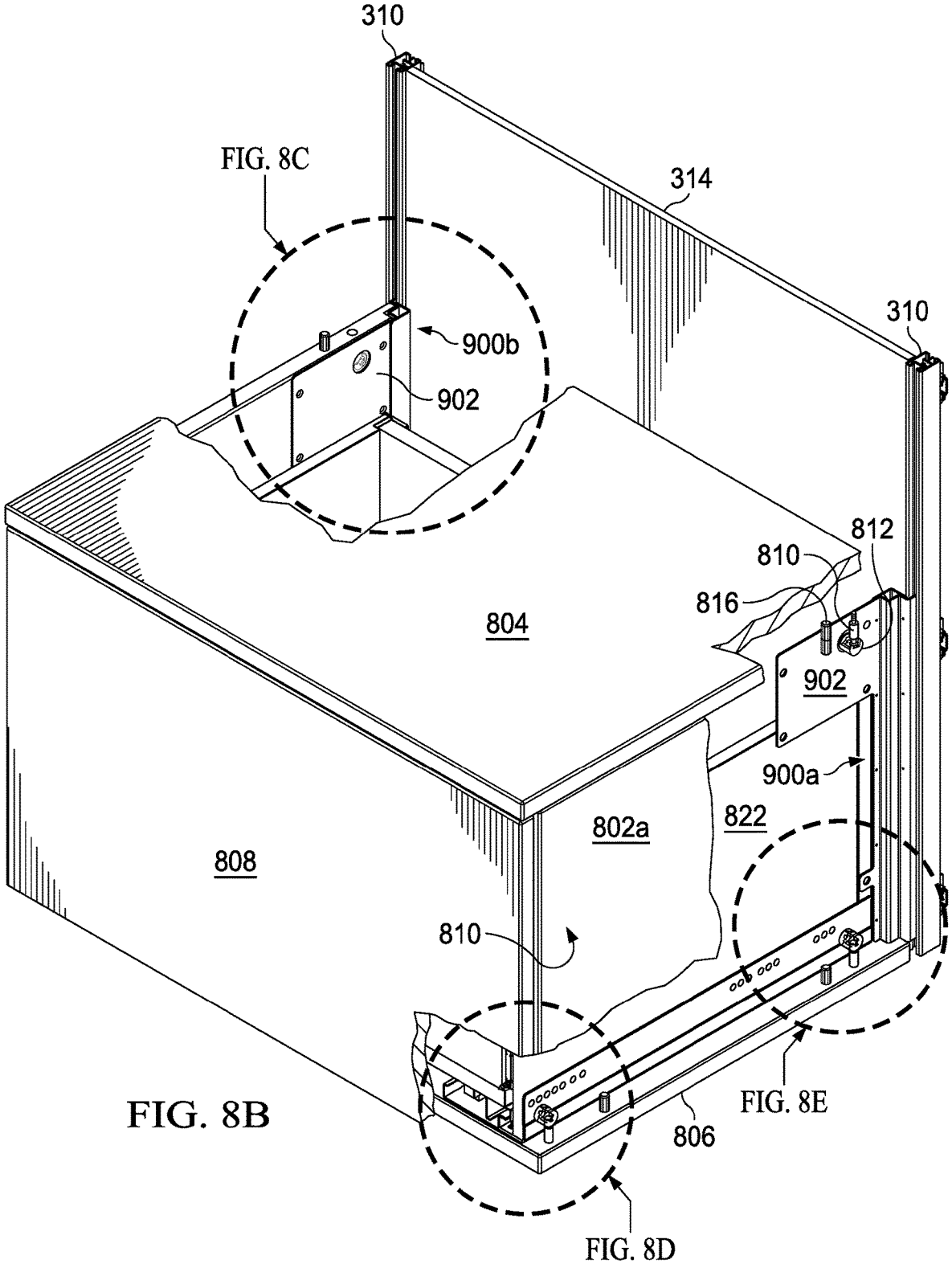
FIG. 8B is a perspective view of the drawer of FIG. 8A, with portions of the drawer cut away.
Figure 8C:
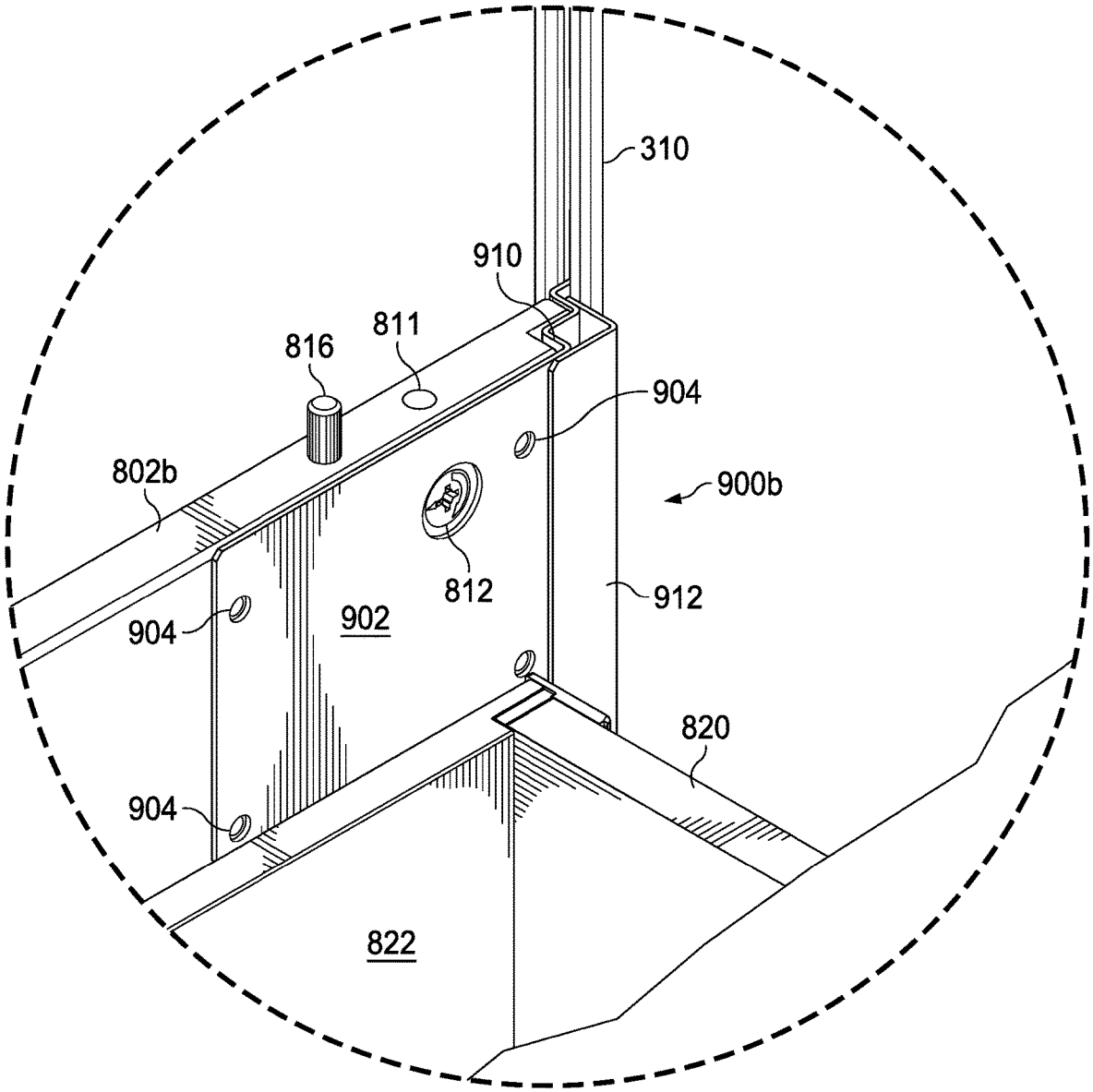
FIG. 8C is a view of a portion of FIG. 8B that has been enlarged to show additional detail.
Figure 8D:
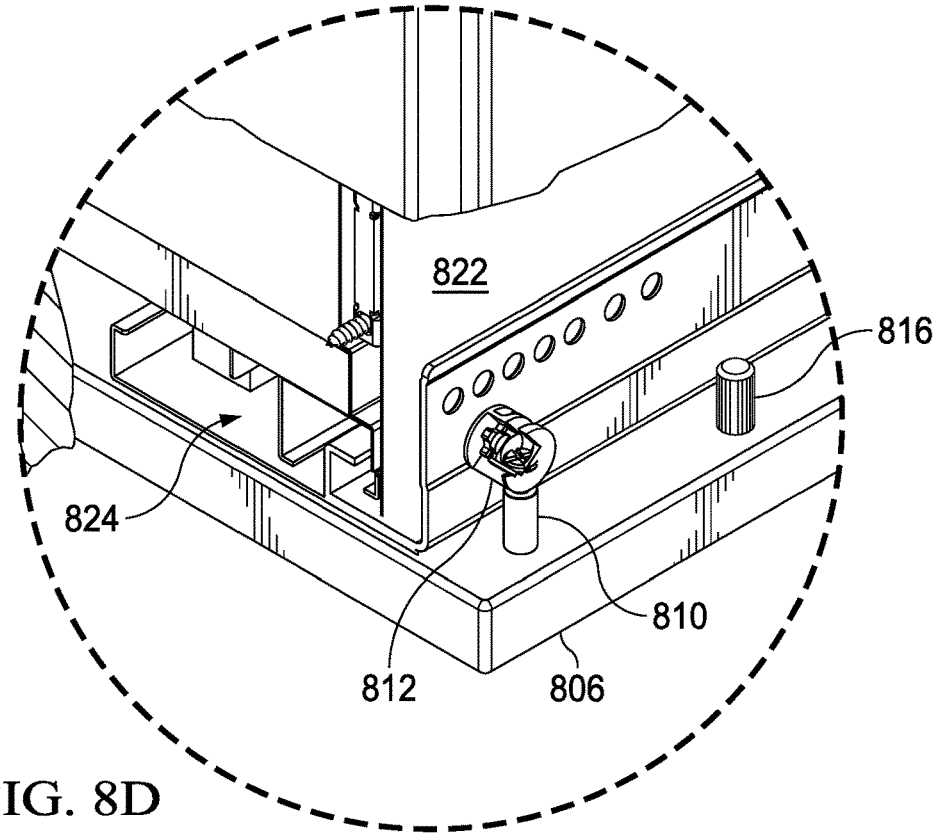
FIG. 8D is a view of another portion of FIG. 8B that has been enlarged to show additional detail.
Figure 8E:
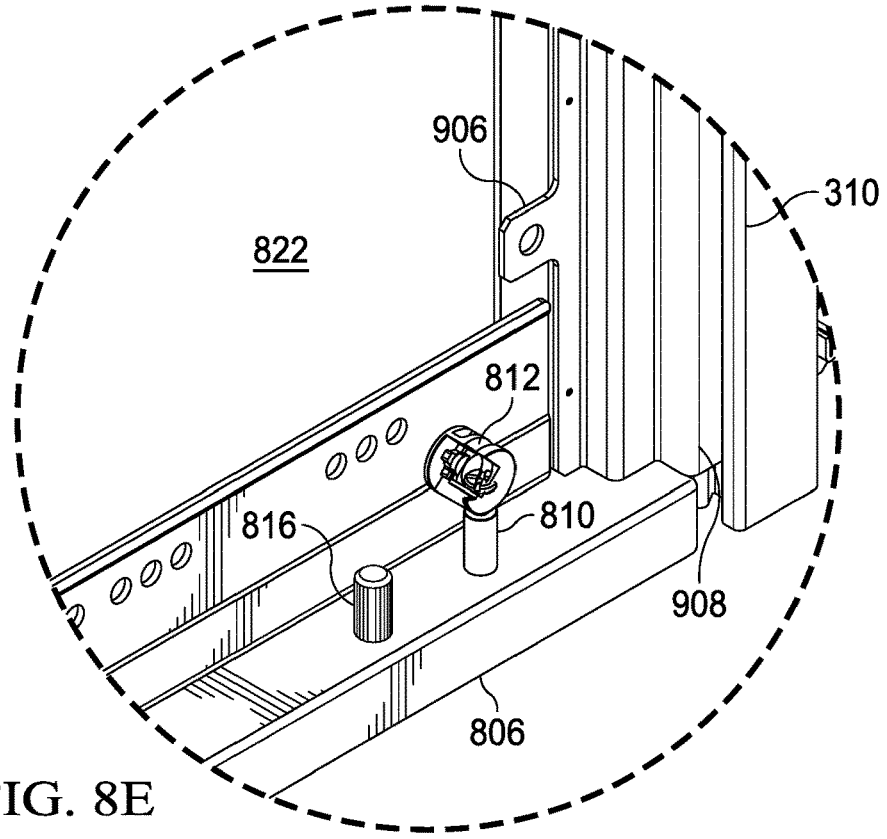
FIG. 8E is a view of yet another portion of FIG. 8B that has been enlarged to show additional detail.
Figure 9A:
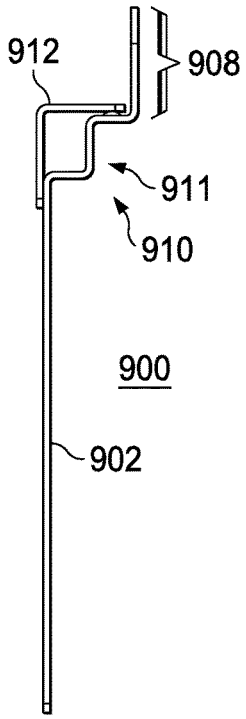
FIG. 9A is a top view of a bracket used to support the drawer of FIGS. 8A-8E.
Figure 9B:
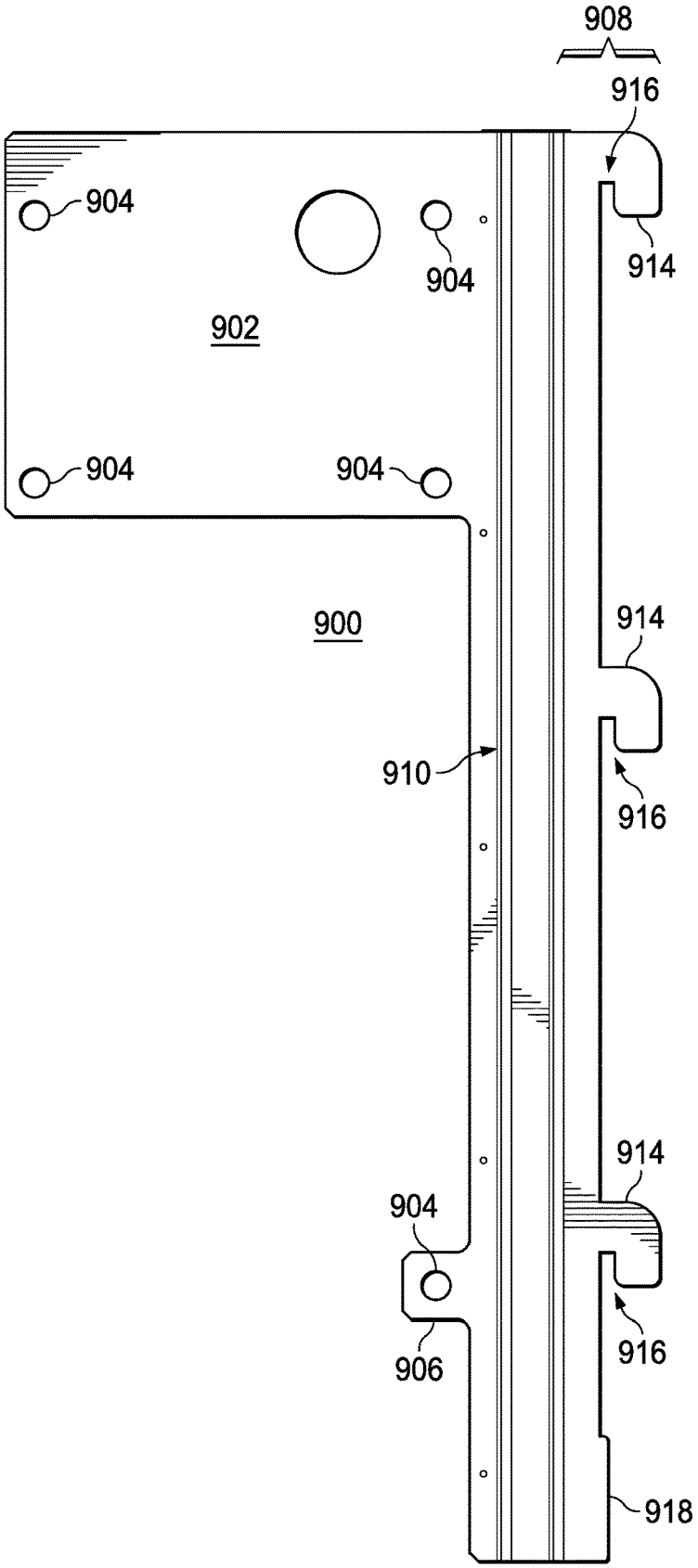
FIG. 9B is a side view of the bracket of FIG. 9A.

Referring now to FIGS. 7A-7C, which show two representative examples an installation of panel brackets for supporting the back panel 314 that is shown in several of the views in the preceding figures. Vertical standards 310 are connected with or mounted to the wall 312 in the example using at least one, and in these examples two or three horizontal tracks or rails 700. The horizontal rails are screwed to the wall, for example, although they may be attached in any other way. The standards are then connected or hung from one or more of the horizontal rails 700. To support the panel 314 between the standards, "c"-shaped panel brackets 702 and 714 are hung from a horizontal flange 704 formed on top of each of the rails and spaced forwardly of the wall 314, or from a flange 708 of a clip 706 that is attached to the wall with a fastener such as a screw, with a space between the flange 708 and the surface of the wall 314. The clip is used if there is no horizontal track from which to hang a panel bracket 702 or 714. In this example, each of the brackets 702 has a pair of leg portions 702*a*, each with a foot 702*b* that is capable of resting against the wall 314. Either foot will fit between the flange 704 and 708 and wall 312 to act as a hook to hold the bracket 702 or 714 on the horizontal rail. Similarly, each of the panel brackets 714 has, in this example, a pair of leg portions 714*a*, each with a foot 714*b*. However, in an alternative embodiment, only one leg portion has a foot, and other structures could be substituted to hook the panel bracket onto a flange of either a horizontal rail or a clip.

The leg portions 702*a* and 714*a* of each of the panel brackets 702 and 714 position the bracket and its attachment portion 702*c* and 714*c*, respectively, a predetermined distance from the wall so that it has a predetermined alignment with the vertical standards 310. In this example, the panel's front surface is aligned with the front of the vertical standards once attached to the panel brackets. The legs also orient the attachment portion 702*c* and 714*c* of each so that a flat part of a surface of the attachment portions 702 and 714*c*, to which a back side of panel 314 will be adhered—an attachment surface—is parallel to the surface of the wall. For example, on the attachment surface of attachment portion 702*c* and 714*c* is an adhesive 710, with which a back side of panel 314 is adhered to the bracket once a sufficient number of brackets are positioned and the panel 314 is pressed against the brackets. Non-limiting representative examples of adhesives include double-sided adhesive tape, glue or any other adhesive that will bond the back of the panel to the bracket. Fasteners such as hook-and-loop fasteners could also be used to adhere the panel to the brackets.

Panel brackets 714 further include a shallow ledge 714*d* that extends below the attachment portion 714*c*, on which a lower or bottom edge of a panel may rest. For panel bracket 714, the adhesive 710 does not extend the full length of the attachment surface of attachment portion 714*c* in order to allow a bottom edge of the back panel to rest on ledge 714*d* without with adhering to the bracket in order to allow it to be properly positioned before being pressed against the brackets. For panel bracket 702, the adhesive may extend the full length of the surface of the attachment portion 702*c*, though in alternative embodiments it does not have to extend the full length. One or more brackets 714 are used instead of brackets 702 on a lower horizontal rail or clip, where a bottom edge of a panel will be located. Use of the brackets 714 is optional.

In an alternate embodiment, the back panel may be held in place by inserting the ends of the panels in grooves formed on the side of the vertical standard 310. An example is shown in PCT Application No. PCT/US2018/050781.

Referring now to FIGS. 8A-8E and 9A-9B, drawer 800 is another example of a storage component for a storage system like the one described above that is mounted on low profile cantilevered brackets connected with vertical standards. The figures show drawer 800 in a representative installation comprising two vertical standards 310 connected to a wall (not shown). The distance between them is a standard distance for the storage system, allowing multiple drawers 800 as well as shelves 300 and 600 to be arranged vertically on the same set of vertical standards, as well as side-by-side by adding a third vertical standard, with the vertical standards spaced apart by the standard distance, the storage components being mounted side-by-side each having a low profile cantilevered bracket sharing the same standard and occupying, in at least one embodiment, the same openings or slots to achieve a close fit.

The drawer in this example is comprised of a box-shaped enclosure. A drawer is mounted within the enclosure so that it can be slide in and out of it. The enclosure is comprised of two side panels 802*a* and 802*b*, each of which is joined to a top panel 804 and a bottom panel. The drawer front 808 overlaps the ends of the side panels 802*a* and 802, with its end surface flush with the surfaces of the side panels, to hide the ends of the side panels when the drawer is closed. The bottom of the drawer front 808 also overlaps the bottom panel 806 to hide the end of the bottom panel when the drawer is closed. Only the front facing edge of the top panel 808 is exposed, with the top edge of the drawer front 808 fitting tightly under the top panel and the surface of the drawer front flush with the front edge of the top panel 804.

A pair of cantilevered brackets 900*a* and 900*b* (which are mirror images of each other) are used to hang the enclosure on the vertical standards 310. Each side panel 802*a* and 802*b* is connected to support member 902 that projects out from the bracket using fasteners. In the illustrated embodiment, the support member 902 includes screw holes 904 for receiving wood screws (not shown) for attaching the support to an inside surface of each side panel 802*a* and 802*b*. A lower tab 906 may also be used to attach the side panel to the bracket at a lower position to prevent or reduce application of torsional forces on the fasteners connecting the side panels to the support member 906. The support projection 902 is coupled to a connection interface 908 by an offset 910 so that the support is offset inwardly with respect to a center plane defined by the connection interface 908 and its rearward projections 914, the center plane being parallel with a center axis of the standard and extending through a column of slots formed on the front the vertical standard into which the rearward projections are inserted. The offset of the support projection at least partially accommodates the thickness of the panel. If desired, it allows for the outer surface 810 of each side panel to be aligned with or inside the plane of the connection interface 908. In a preferred embodiment, the amount of the offset is therefore equal or greater than the thickness of the side panel, though in alternative embodiments it could be less than this thickness. Furthermore, the offset portion begins close to the vertical standard and allows at least the outermost portion of the side panels to reach close to the vertical standard.

The offset portion 910 includes a step 911 that results the offset portion 910 having stairstep cross-section. When connected with bracing 912, the step 911 forms a box-shaped structure that strengthens and reinforces the bracket to help to prevent the bracket from bending at the offset portion under the load of the drawer 800.

Except for the bracing 912, the bracket—the support projection 902, the offset 910, the connection interface 908, and rearward projections 914—is, in one embodiment, formed from a single piece of material, such as steel, that is cut and then folded. The bracket is thus able to maintain a narrow profile.

The bottom panel and top panel are attached to the side panels using 804 and 806 using fasteners or other means for joining them to from a rigid, box like enclosure that will support the drawer. In this example, posts 810 that are screwed into the bottom and top panels are inserted into holes 811 formed along the top and bottom edges of the side panels and then locked using cam locking nuts 812 are inserted prior to the posts are inserted and rotated from the inside the enclosure. Openings 814 are formed in the support members 902 to allow for access to the cam locking nut. Optional dowels 816 can also be used to help to hold the panels together. The entire enclosure can be assembled with a screw driver.

The connection interface 908 comprises rearward projections 914, each of which is inserted a separate slot in a column of slots (not visible due to raised portions extending from the front wall that obscures from side angle the column of slots) in the front of the vertical standards. Each of the rear projections 914 has cut or formed in it a slot 912 that fits over a lower, transverse edge of one of the slots in the column of slots on the vertical standard 310. The rearward projections 914 thus form hooks with which the bracket is hung on the vertical standard. The connection interface also comprises another rearward extension in the form of a tab 918 falls into a slot once the rearward projections are inserted and pushed down over the lower edges of the slots, as described above, thus helping to ensure that the hooks are and remain properly seated.

In this example, the drawer frame includes, in addition to drawer front 808, a bottom 818, rear 820 and sides 822. The drawer is, for example, supported within the enclosure by slides, drawer extensions, or similar mechanism 824 that is connected between the drawer frame and the bottom panel 806. However, many types of drawer slides, extensions, push-to-open and soft close mechanisms could be substituted.

The structure of the bracket enables the side panels to hide most of the bracket while also centering the outer surface of the sides of the enclosure on the vertical standard in a manner that allows single, shared vertical standard to be used to support two drawers side-by-side. Furthermore, because of the thin connection interface 904 and wider slots, the brackets 900*a* and 900*b* of adjacent drawers are able to share the same the same slots on the vertical standard. Thus, the two drawers can be hung on the vertical standers very close to each other, with side panels of the two drawers abutting each other. The close fitting gives the storage system an appearance similar to custom drawers and allows for more pleasing aesthetics.

Although described in reference to a drawer, in alternate embodiments the drawer could be omitted, or another type of organizational or storage component could be substituted for the drawer, without substantially altering the enclosure or how it is constructed and supported by the cantilevered brackets.

Non-limiting representative examples of verticals standards that can be used with the components described above are disclosed or described in PCT Application No. PCT/US2018/050781. However, these standards can be adapted to be connected or otherwise supported on a wall using fasteners, clips, and brackets, and in other ways. Additionally, the vertical standards may, optionally, include raised portions extending from the front of the vertical standard that visually obscures from side angles one or more columns of slots to which the cantilevered brackets are connected.

Unless otherwise expressly stated, the foregoing description of exemplary and preferred embodiments, and accompanying drawings, are intended to be representative, non-limiting examples of the invention that is claimed, and may describe multiple inventions in addition to the one set forth in the claims. The invention, as defined by the appended claims, is therefore not intended to be limited to the details of the described examples and embodiments, or to any preferred embodiment. Furthermore, the subject matter of a claim is not intended to be limited by statements made in reference to aspects of any of the embodiments or examples other than those particular aspects that are expressly set forth in a claim. Rather, the invention, as claimed, is intended to encompass equivalents of the examples and embodiments, as well as alterations and modifications to them that come within the ordinary and customary meaning of the claim terms, unless such terms have been expressly defined in this specification or otherwise subject to construction, such as under 35 U.S.C. § 112(f), that are required by statute.

What is claimed is:

1. A cantilevered bracket for a storage system comprising:

an elongated support with proximal and distal ends, the elongated support having along at least a portion of its length a top edge, a bottom edge, and two parallel side surfaces on opposite sides of the support that extend between the top edge and bottom edge;

a connection interface at the proximal end of the elongated support, the connection interface including at least one rearward extension that is configured to be inserted into an opening in a vertical standard to retain the cantilevered bracket on the vertical standard; and a ledge that is affixed to and projects outwardly from one of the two parallel side surfaces, the ledge extending along at least a portion of the length of the elongated support between the top and bottom edges, the ledge having an upper surface below the top edge and a lower surface above the bottom edge along an entire length of the ledge;

wherein the elongated support and connection interface are fabricated from a single sheet of metal having a uniform thickness, the sheet of metal having opposing surfaces that form the two parallel side surfaces of the elongated support;

wherein the ledge is formed by a first planar portion of an "L" shaped unitary piece, the "L" shaped unitary piece extending along at least a part of the length of the elongated support and having an "L" shaped cross-section along its length;

wherein the "L" shaped unitary piece has a second planar portion extending downwardly along a side surface of the elongated support;

wherein the first planar portion has a first edge, and the second planar portion has a first edge, the first edge of the first planar portion joining with the first edge of the second planar portion to form the "L" shaped cross-section, the first planar portion extending at a right angle to the side surface;

wherein the first planar portion has an unattached free edge opposite of its first edge, and the second planar portion has an unattached free edge opposite its first edge; and wherein the ledge has projecting from its upper surface at least one post that is attached to the upper surface of the ledge and adapted to be received within an opening formed in a bottom side of a shelf.

2. A cantilevered bracket according to claim 1, wherein the upper surface of the ledge extends at a right angle from the side surface of the elongated support.

3. A cantilevered bracket according to claim 1, wherein a distance between the upper surface of the ledge and the top edge is uniform along the length of the ledge.

4. A cantilevered bracket according to claim 1, wherein the ledge extends without interruption from near the connection interface to near the distal end of the bracket.

5. A cantilevered bracket according to claim 1, wherein the elongated support and the rearward extension of the connection interface have a uniform thickness.

6. A cantilevered bracket according to claim 1, wherein the rearward extension has defined in it a slot configured to cooperate with an edge of an opening in a vertical standard.

7. A cantilevered bracket according to claim 1, wherein the elongated support and rearward extension is cut from a single sheet of material.

8. The cantilevered bracket for a storage system of claim 1, further comprising:

a closet rod hanger comprised of a closet rod holder at one end of a strap and tab extending at a right angle at an opposite end of the strap; and a slot for receiving the tab, the slot formed in the ledge near the side surface of the cantilevered support from which the ledge extends;

wherein the closet rod hanger and slot are configured for the tab to be inserted through the slot and then rotated toward the side surface with the tab engaging an upper surface of the ledge and the strap and closet rod holder are resting against the side surface.

9. The cantilevered bracket for a storage system of claim 1, further comprising a post that projects upwardly the upper surface of the ledge.

10. A storage system comprising:

first and second cantilevered brackets;

a shelf configured to be supported between the first and second cantilevered brackets;

wherein each of the first and second cantilevered brackets is comprised of an elongated, vertically oriented, planar support member with a top edge, a bottom edge, side surfaces extending between the top edge and bottom edge, a connection interface with at least one rearward extension that is configured to be inserted into an opening in a vertical standard to retain the cantilevered bracket on a vertical standard, and a ledge that projects outwardly from one of the side surfaces between the top edge and bottom edge to support the shelf, with the ledge having an upper surface between the top edge and the bottom edge that supports the shelf between the brackets, the elongated support and connection interface being fabricated from a single sheet of metal having a uniform thickness, the sheet of metal having opposing surfaces that form the two side surfaces of the elongated support member; and wherein, the upper surface of each ledge has affixed to it an upwardly projecting post that is configured to be inserted into a corresponding opening formed in a bottom surface of the shelf when the shelf is placed on the ledge, the opening and the post having a predetermined spatial relationship.

11. A storage system according to claim 10, wherein the upper surface of the ledge extends at a right angle from the side surface of the elongated support.

12. A storage system according to claim 10, wherein a distance between the upper surface of the ledge and the top edge is uniform along the length of the ledge.

13. A storage system according to claim 10, wherein the ledge extends without interruption from near the connection interface to near the distal end of the bracket.

14. A storage system according to claim 10, wherein the shelf has a top surface that is aligned with the top edge of each of the first and second cantilevered bracket.

15. A storage system according to claim 10, wherein the shelf has a front edge aligned with a front edge of each of the first and second cantilevered brackets.

16. The storage system according to claim 15, wherein the shelf further includes means for locking the post within the opening.

17. The storage system of claim 10, further comprising:

a closet rod hanger comprised of a closet rod holder at one end of a strap and tab extending at a right angle at an opposite end of the strap; and a slot that is formed in at least one the ledges extending from the side surface to which it is attached, the slot formed near the side surface from which the ledge extends;

wherein the closet rod hanger and slot are configured for the tab to be inserted through the slot and then rotated toward the side surface with the tab engaging an upper surface of the ledge and the strap and closet rod holder are resting against the side surface from which the ledge extends.

18. The storage system of claim 10, wherein the ledge and shelf are configured for a bottom side of the shelf to rest on the upper surface of the ledge the bracket with a side edge of the shelf abutting the surface of the bracket from the ledge extends.

19. The storage system of claim 10, wherein the post and the opening are configured for the post to be inserted into the opening on the bottom surface of the shelf when the shelf is placed on the upper surface of the ledge.

20. A closet rod hanger system for storage system comprising:

first and second cantilevered brackets, each of the first and second cantilevered brackets comprising a cantilevered support projection having a top edge and ledge that project outwardly from one side of the support projection below the top edge that is configured to cooperate with a bottom a shelf extending between the cantilevered brackets;

a closet rod hanger comprising a closet rod holder at one end of a strap and tab extending at a right angle at an opposite end of the strap;

wherein the first and second cantilevered brackets each have a slot formed in the ledge near the cantilevered support projection for receiving the tab; and wherein the closet rod hanger and slot are configured for the tab to be inserted through the slot and the closet rod hanger then rotated toward the one side with the tab engaging in upper surface of the ledge and the strap and closet rod holder resting against the side of the support projection.

21. A closet rod hanger system for storage system according to claim 20, wherein the ledge of each of the first and second cantilevered brackets comprises a depression formed in the upper surface for accommodating the tab.

22. A closet rod hanger system for storage system according to claim 21, wherein the upper surface of the ledge extends at a right angle from the one side of the support projection.

23. A closet rod hanger system for storage system according to claim 20 wherein the closet rod holder comprises a bottom connected with the strap and two sides that extend from the bottom and are deflectable with respect to the bottom.

24. A closet rod hanger system for storage system according to claim 23, wherein the two sides are biased inwardly to pinch against an end of a closet rod when inserted.

25. A closet rod hanger system for storage system according to claim 20, wherein the closet rod hanger is integrally formed.

26. A closet rod hanger system for storage system according to claim 20, wherein a distance between the upper surface of the ledge and the top edge is uniform along a length of the ledge.

27. A closet rod hanger system for storage system according to claim 20 further comprising a shelf with a top surface that is aligned with the top edge of each of the first and second cantilevered brackets bracket.

28. A closet rod hanger system for storage system according to claim 20, wherein each of the first and second cantilever brackets further comprise a connection interface configured to connect to a vertical standard, the connection interface comprising at least one rearwardly extending hook.

29. A closet rod hanger system for storage system according to claim 20, wherein the support projection for each of the first and second cantilevered brackets is comprised of a flat sheet of metal.

* * * * *